United States Patent [19]

Taylor

[11] Patent Number: 4,822,331

[45] Date of Patent: Apr. 18, 1989

[54] CENTRIFUGE

[76] Inventor: David C. Taylor, 45 Warren Dr., Patterson, N.Y. 12563

[21] Appl. No.: 118,570

[22] Filed: Nov. 9, 1987

[51] Int. Cl.[4] ..... B04B 5/02

[52] U.S. Cl. ..... 494/16; 494/84

[58] Field of Search ..... 494/1, 16, 7–9, 494/13, 16, 47, 61, 84, 83, 52, 46, 23, 37, 39; 318/542, 361

[56] References Cited

U.S. PATENT DOCUMENTS

| | | | |
|---|---|---|---|
| 3,339,836 | 9/1967 | Mitchell et al. | 494/16 |
| 3,366,320 | 1/1968 | Cho | 494/16 |
| 3,439,871 | 4/1969 | Unger | 494/16 |
| 3,901,434 | 8/1975 | Wright | 494/16 |
| 3,970,245 | 7/1976 | Aeschlimann | 494/9 |
| 4,010,893 | 3/1977 | Smith et al. | 494/1 |
| 4,099,667 | 7/1978 | Uchida | 494/7 |
| 4,142,138 | 2/1979 | Taylor et al. | 318/542 |
| 4,226,669 | 10/1980 | Vilardi | 494/61 |
| 4,360,151 | 11/1982 | Cowell et al. | 494/16 |
| 4,372,483 | 2/1983 | Wright | 494/16 |
| 4,412,830 | 11/1983 | Strain et al. | 494/16 |
| 4,449,964 | 5/1984 | Westberg et al. | 494/16 |
| 4,451,248 | 5/1984 | Williams | 494/84 |
| 4,693,702 | 9/1987 | Carson et al. | 494/61 |

*Primary Examiner*—Timothy F. Simone

[57] ABSTRACT

A centrifuge, including a motor assembly with a low-speed brushless induction motor connected to the spindle assembly and controlled by an electrical circuit for gently shifting phases of operation but with rapid acceleration and deceleration, the centrifuge rotor for use on the spindle assembly having interlocks with the electrical circuit and being completely enclosed for safety, the resulting motor mechanism and rotor being comparatively quiet in operation, the motor and spindle assemblies being capable of use with rotating devices and loads other than centrifuges and the centrifuge rotor being capable of holding various insertable tube carriers to provide operation with wide variety of test samples while also being substantially free of corrosion from sample spillage.

27 Claims, 13 Drawing Sheets

NOTE: $R_2 \div R_1$ TYPICALLY GREATER THAN 6

CENTRIFUGE

BACKGROUND OF THE INVENTION

Centrifuges are well-known, but to date, centrifuges, particulary those designed to process so-called "micro sample tubes" often called "Eppendorf type tubes", have been so noisy as to preclude working or even holding conversation in their vicinity when they are in operation. This highly undesirable noise is generated primarily by the circular array of sample tubes spinning exposed to the air stream at angular velocities in the range of ten thousand to sixteen thousand revolutions per minute with sample tube tip velocities in the range of two hundred twelve to three hundred thirty-nine feet per second. Still another source of such noise is the characteristic whine of the high-speed, brush-type electric motor used in centrifuges. High-speed, brush-type electric motors are inherently noisy with a characteristic high-pitched whine caused by the carbon brushes riding on the segmented surface of the commutator.

To lessen the primary cause of noise, it has been known to enclose the lower portions of the sample tubes within a monolithic or fabricated body sometimes referred to as a "windshield". Although this does help, the filler neck of each tube still remains exposed to the air, thereby still generating considerable undesirable noise.

Corrosive damage is still another problem with known centrifuges, particulary those of the fixed angle design which is the most popular design. So-called "fixed angle" designs carry the sample tube or container rigidly with the major axis of the sample tube disposed typically but not necessarily at thirty degrees to forty-five degrees from the vertical or spin axis. Sample tube receptacles are typically formed by boring holes in a monolithic body, often termed a "rotor". Non-monolithic rotor configurations are also known where tube receptacles are otherwise provided by a structure which is permanently assembled into such a rotor.

It is in the tube receptacles where hidden corrosion begins when a sample tube ruptures thereby allowing the possibly corrosive contents of the sample tube to become trapped in the blind tube receptacles.

Still another disadvantage of known drive assemblies for centrifuges is that there is either no braking or only ineffective braking, which braking becomes progressively less effective as zero speed is approached, resulting in wasted time and an undesirably long exposure of test samples to elevated temperatures.

Centrifuge devices usually have some means to protect the operator from possible injury caused by inadvertent contact with a spinning rotor. Some of the most advanced centrifuges interlock the rotor chamber access door to prevent the access door from being opened when the rotor is turning. However, the means for detecting motion of the rotor could fail or be sufficiently imprecise that the access door could be opened on a spinning rotor. Still another disadvantage of some existing interlock systems is failure of the interlock system in the event of a power interruption, after the rotor has attained considerable angular velocity.

Often it is necessary to perform a very short run or spin with a centrifuge. The duration of such a short spin is typically 10–30 seconds, which until this invention was too short for interval timers of the type normally applied to accommodate.

Still another disadvantage of the centrifuge known in the art is undesirable variations of centrifugal force exerted on the sample due to variations in the speed of rotation and the fact that centrifugal force on a particle in a sample tube varies as the square of the speed of rotation of the rotor.

Still another disadvantage with the present art is contamination when a sample tube containing radioactive or biohazardous material ruptures during processing. Some designs do use a fully-enclosed rotor so that the liquid would be contained within the rotor if spilled. Even with these units, the rotor cover must be removed in order to remove the rotor body and the sample tubes contained therein, thereby allowing contaminants to escape. Therefore, with the current state of the art, the usual way to remove the hazardous material is to place the entire centrifuge in a ventilated hood for rotor access and cleanup which is extremely inconvenient and cumbersome.

Still another disadvantage of those existing centrifuges which offer effective-braking means is failure to provide a gentle approach to the zero speed state. An excessive rate of deceleration, if maintained to the actual instant of stopping, can cause undesirable agitation and re-suspension of certain unstable and non-compacted "pellets" in the test material.

SUMMARY OF THE INVENTION

In accordance with this invention, a centrifuge is provided which is powered by a relatively low-speed brushless induction-type electric motor which drives the spindle assembly on which a rotor is mounted at a higher rotational speed than the driving motor by means of a speed increasing belt drive. The tubes are mounted in a removable tube carrier placed within a rotor body.

The configuration of the carrier allows utmost variety in the size of the samples processed in a given run. By the use of different carriers, the payload can be optimized. The use of such a carrier within a rotor body permits the carrier to be loaded and unloaded both within or without the rotor base. A safety device prevents operation without the rotor cover being in place on the rotor body and an access door latch switch which is safety interlocked permits operation only when the rotor is completely secured within the rotor enclosure. An automatic short spin cycle as well as a timed spin for a range of intervals are provided. A fail safe, zero-speed detection means is provided to indicate the stopped condition of the centrifuge rotor and an automatic shifting of motor capacitance provides a gentle start followed by rapid acceleration and then an automatic return to steady operation. The deceleration similarly starts gently, then reduces speed rapidly and finally allows the rotor to stop gently.

DETAILED DESCRIPTION OF DRAWINGS

DETAILED DESCRIPTION OF THE INVENTION

Figure 1:
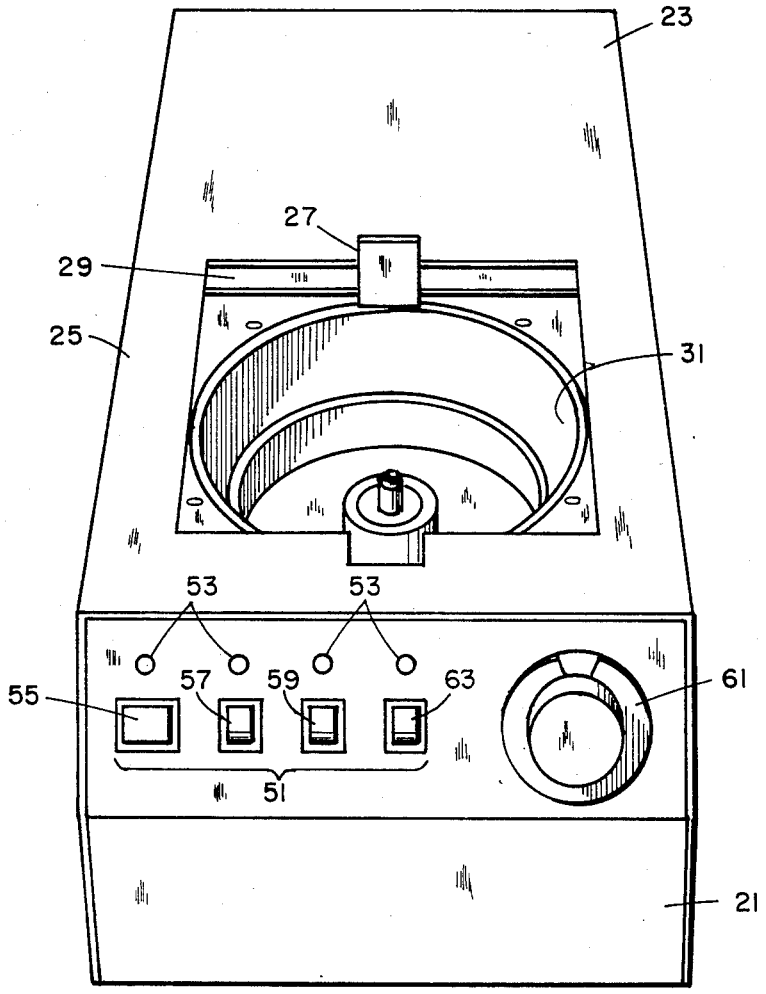
FIG. 1 is a front perspective view of the front and top of the centrifuge showing the control panel and with the access door slid back with the handle of the access door extending upwardly and with the rotor cover removed, showing the rotor body without a tube carrier within the rotor chamber.

Referring now to FIG. 1, a front panel 21 and a top panel 23 of an enclosure 25 for the Centrifuge are shown. A handle 27 for an access door 29 is shown protruding upwardly. The access door 29, shown in its open position, slides open and closed in a pair of channels (not shown) located in the enclosure. A rotor chamber 31, which is a bowl-shaped enclosure surrounds a rotor 33. The rotor 33 (FIG. 10) is mounted in the rotor chamber 31 and includes a rotor body 35, which is cylindrical, having a diameter smaller than the rotor chamber 31 so as to be able to spin freely within the rotor chamber 31. The rotor body 35 includes an outside cylindrical portion 37 and a flat base portion 39 with a cylindrical hub 41 extending vertically upwardly from the flat base portion 39 and being concentrically located within the outside cylindrical portion 37. The hub 41 is closely fitted onto an adapter 43 which is mounted on a spindle assembly 45. A bolt 47, is used to remove the rotor 33 from the spindle assembly 45, as will subsequently be explained.

On the front panel 21 are a series of four electrical switches 51 two of the pushbutton variety and two of the rocker-type, each switch 21 having a light 53 to indicate when its respective switch 51 is in use. Starting at the left-hand side (facing FIG. 1) is the main power switch 55 which is of the rocker type and to right of that is the brake switch 57 of the pushbutton variety for emergency stopping. Proceeding again toward the right is the run switch 59, which is of the pushbutton variety and which also operates the automatic short-spin cycle with a timer 61 set to zero. The next switch to the right is the interval timer control switch 63 also of the rocker variety which is used in conjunction with the timer 61 to the far right.

Figure 2:
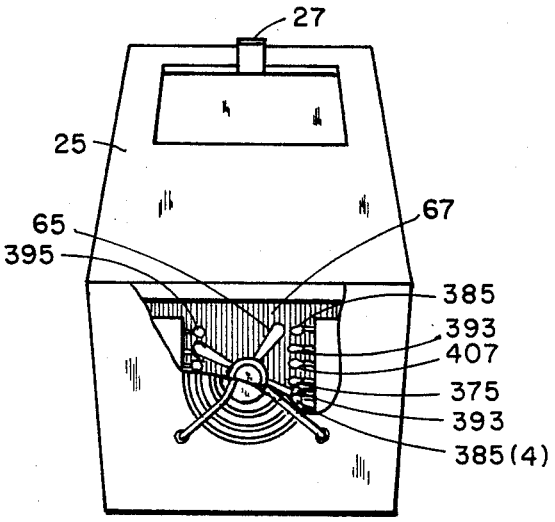
FIG. 2 is a rear perspective view of the centrifuge showing the exhaust opening for the cooling air and partially broken away to show the placement of temperature sensitive elements in the air flow of the cooling fan.

Referring now to FIG. 2, a cooling fan 65, which is of known design, is shown generally centrally located in the rear inside of the enclosure 25. The cooling fan 65 may be of any type used in electronic cooling applications. Timing elements 67 which change resistance by element temperature are mounted on printed circuit boards which are located on each side of the cooling fan 65 so as to be exposed to maximum cooling air flow during operation of the cooling fan 65.

Figure 3:
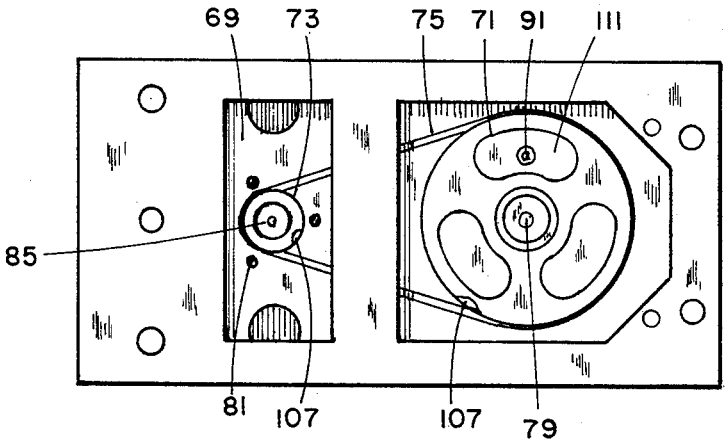
FIG. 3 is a plan view of the bottom of the centrifuge showing the belt and the drive pulley and the driven pulley along with the bottom of the outside enclosure and the underside of the base plate, but with the belt access cover removed.
Figure 4:
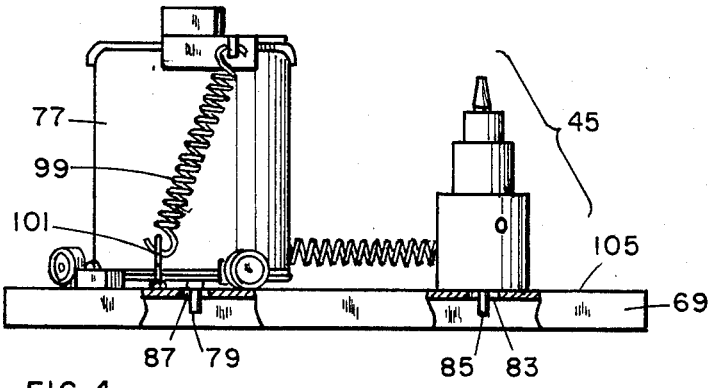
FIG. 4 is a side elevation of the left side (facing the control panel) of the baseplate with the motor assembly and the spindle assembly mounted on the upper surface of the base plate but with the outside enclosure removed.

Referring now to FIG. 4 of the drawings, there is shown a base plate 69. Both longitudinal edges of the baseplate 69 are bent downwardly at a right angle for strength as well as to provide a space for both a drive pulley (FIG. 3) 71 and the driven pulley 73 as well as belt 75 mounted thereon, as shown in FIG. 3. Mounted on the upper surface of base plate 69, there is the spindle assembly 45. Also mounted on the base plate 69 is a motor assembly 77 which is used for providing the rotating power to the spindle assembly 45 by means of the belt 75.

In FIG. 3, there is shown the underside of the Centrifuge. The drive pulley 71, which is the larger of the two pulleys 71, 73, is rigidly affixed to a lower shaft extension 79 of the motor assembly 77. The driven pulley 73 is shown affixed to the lower shaft extension 85 of the spindle assembly 45. The belt 75 connects the driven pulley 73 and the drive pulley 71 which belt 75 is preferably of the well-known miniature, precision V-belt design. Since the drive pulley 71, which is mounted on the motor assembly 77, is substantially larger than the driven pulley 73 mounted on the spindle assembly 45, the driven pulley 73 rotates at a substantially higher speed of rotation than the speed of rotation at which the drive pulley 71 rotates.

Figure 5:
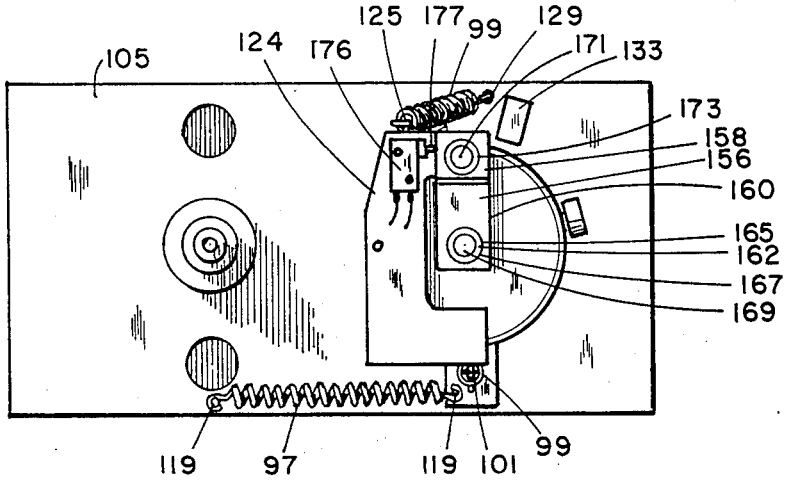
FIG. 5 is a plan view of the top of the motor assembly and the spindle assembly on the upper surface of the base plate, showing the reverse detection arm and the broken belt detector switch.
Figure 6:
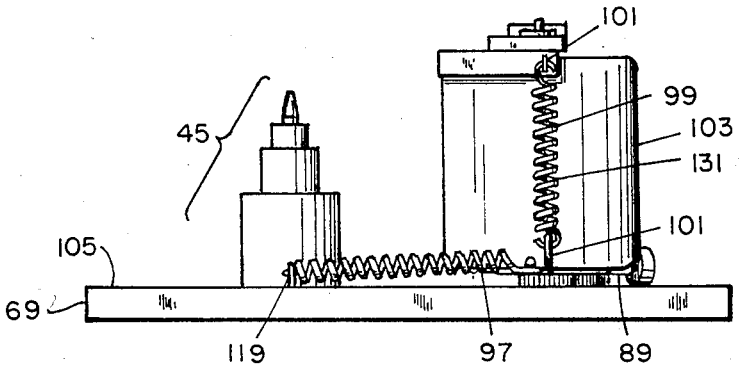
FIG. 6 is a right side elevation (facing the control panel) of the baseplate assembly similar to FIG. 4, showing the drive tension spring.

The underside of the base plate 69 (FIG. 3) can be seen behind the drive pulley 71 and the driven pulley 73. In the baseplate 69 and symmetrically about the center of the driven pulley 73 can be seen three bolts 81 used to secure the spindle assembly 45 to the base plate 69. An opening 83 in the base plate 69 permits a lower shaft 85 of the spindle assembly 45 to protrude through the base plate 69. Another opening 87 is also provided in the base plate 69 for the lower extension 79 of the motor assembly 77. This opening 87 in the baseplate 69 for the lower shaft extension 79 is sufficiently large to permit arcuate movement of the lower shaft extension 79 along with the motor assembly 77. Between the motor assembly 77 and the baseplate 69, there is located a tension arm 89 (FIGS. 5 and 6) which is pivotably mounted on the base plate 69 by a pivot pin 91 (FIGS. 3 and 4), but which is rigidly secured to the motor assembly 77. A roller mounting bracket 93, with a pair of rollers 95 affixed thereto, is secured (FIG. 7) to the end of tension arm 89 opposite from a spring 97 (FIG. 6). A pair of hold-down springs 99 (FIGS. 4, 5 and 6) serve to force the entire motor assembly 77 against the base plate 69. Both hold-down springs 99 are secured to the base plate 69 by fasteners 101 (FIG. 4).

A motor 103 (FIG. 6) within the motor assembly 77 is preferably a low speed, brushless, induction type motor. It revolves under load at approximately 3,500 revolutions per minute when powered by a sixty (60) Hertz (cycles per second) alternating current source of power. The Hertz rating absolutely controls the maximum speed of rotation of the motor to no more than 3,600 r.p.m. At a lower frequency should the power source have a lower frequency, the motor's maximum speed will be proportionately lower. An induction-type electric motor having no brushes is inherently and comparatively silent in operation. The rotor 33, however, must be driven typically at 15,000 revolutions per minute and it is for this reason that the ratio of approximately 4.2 to 1 is used for the diameter of the drive pulley 71 (FIG. 3) and the diameter of the driven pulley 73.

Another feature of a brushless, induction-type electric motor is the relatively constant speed which can be obtained with such a motor design with load change or line voltage variation, although load changes and line voltage variation do affect motor speed minimally.

The relative centrifical force on a sample varies substantially with speed change. A ten percent (10%) variation in rotational speed in the Centrifuge results in a nineteen percent (19%) change in the relative centrifical force. Only a twenty percent (20%) speed variation causes a sixty-four percent (64%) variation in the relative centrifical force. However, this is avoided by use of the induction-type of motor which has minimal speed variation with load and voltage line variations.

It is inherent within the design of an alternating current induction type motor that it cannot revolve at a speed greater than predetermined by the number of motor poles and the frequency of the power line. A two-pole induction motor utilizing a sixty (60) Hertz power supply, which alternating frequency of power supply is virtually standard throughout the United States, will have a maximum speed of rotation of 3,600 revolutions per minute regardless of load or line voltage. In fact, nowhere in the world does power line frequency exceed sixty (60) Hertz. In this way, the design being used overcomes one of the inherent problems of the Centrifuge, namely dangerous overspeed or a runaway condition.

Figure 10:
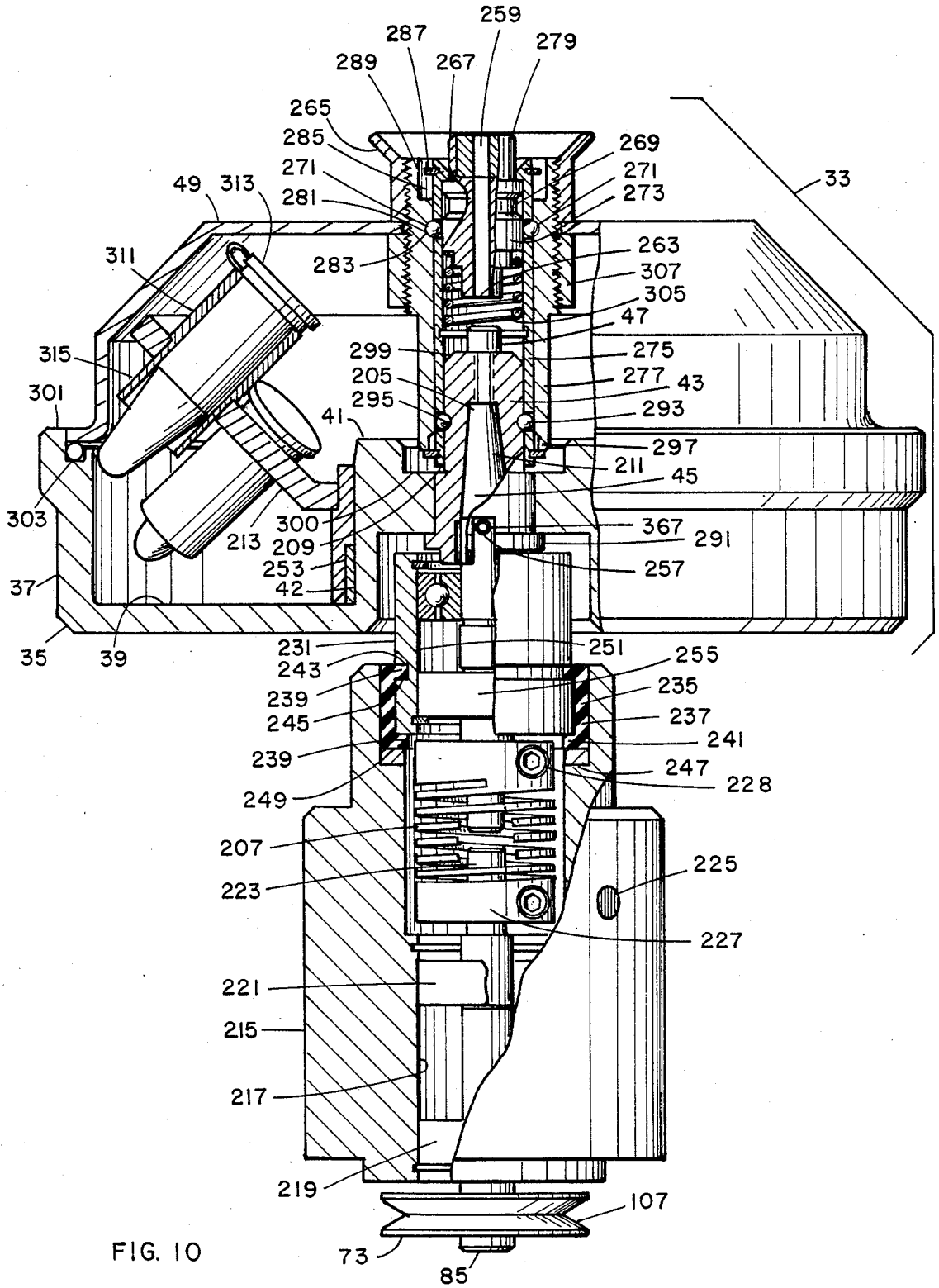
FIG. 10 is a side elevation view of the spindle assembly with the rotor in place on the spindle and with the tube carrier within the rotor body and with portions of the spindle assembly and the rotor broken away.
Figure 13:
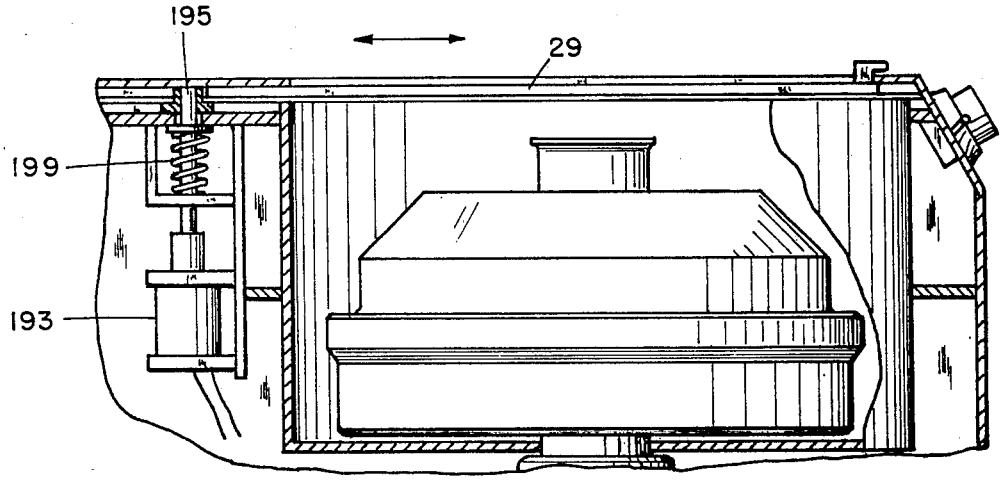
FIG. 13 is a side elevation of the centrifuge substantially broken away showing the rotor in place and showing the lock for the access door.

As is well known, on the Continent, a fifty (50) Hertz power supply is standard. The same motor 103 can be used with fifty (50) Hertz but the ratio of the drive pulley 71 and the driven pulley 73 must be varied proportionately to achieve commensurate rotor speed of the rotor 33 (FIG. 10).

Both in areas using a fifty (50) Hertz power supply and in those using a sixty (60) Hertz power supply, the frequency rating is maintained very constant since without such maintenance of the frequency rating, electric clocks and other synchronous devices would not operate properly. However, line voltage is allowed to vary but this has a minimal affect upon the speed of operation of the induction motor.

Referring again to FIG. 4, there is shown the base plate 69 to which the motor assembly 77 and the spindle assembly 45 are secured and referenced. As has been previously pointed out, the base plate 69 is constructed typically of heavy gage sheet steel with the major edges bent downwards substantially at a right angle which provides a substantial increase in rigidity. The upper surface 105 of the base plate 69 is formed as a flat plane and the spindle assembly 45, as has been explained, is rigidly fastened to the upper surface 105 of the base plate 69 by means of the three bolts 81. In this way, the axis of the spindle assembly 45 and the lower shaft extension 79 of the motor assembly 77 are inherently perpendicular to the base plate 69 and therefore are mutually parallel. Accordingly, the plane of the belt grooves 107 of the drive pulley 71 and the driven pulley 73 are substantially parallel with one another and with the base plate 69 itself.

The tension arm 89 is rigidly secured (FIG. 7) to the roller mounting bracket 93 upon which there are mounted the pair of rollers 95, which are antifriction rollers. The pivot pin 91 is rigidly secured to the lower end of the motor 103 and to the tension arm 89. As previously stated, the pivot pin 91 is rotatably mounted on the base plate 69. The pivot pin 91 engages an opening 111 (FIG. 3) provided in the base plate 69. The lower shaft extension 79 of the motor assembly 77 extends through an opening 113 (FIG. 7) provided in the tension arm 89 as to permit the lower shaft extension 79 to turn freely. As previously stated, the lower shaft extension 79 (FIG. 4) of the motor assembly 77 also protrudes through the opening 87 in the base plate 69 a sufficient length so that the drive pulley or large pulley 71 can be affixed thereto substantially parallel to the base plate 69 and aligned with the smaller driven pulley 73. As explained, the shaft opening 87 is substantially larger in diameter than the lower shaft extension 79 so as to provide sufficient clearance to permit the motor assembly 77 to rotate about the pivot pin 91 without having the lower shaft extension 79 rub against the base plate 69. A spacer washer 115 (FIG. 7) is located between the lower surface of the tension arm 89 and the top surface 105 of the base plate 69 to align properly the tension arm 89.

The inner races of such ball bearings are secured to the roller mounting bracket 93. The outer races of the pair of rollers 95 rest directly on the upper surface 105 of the base plate 69. The rollers 95 may be replaced with a rigidly mounted block on a high friction pad.

The motor assembly 77 is free to pivot about the pivot pin 91 with the weight of the motor assembly 77 distributed between the spacer washer 115 and the pair of rollers 95. The spacer washer 115 and the pair of rollers 95 are spaced from one another to provide a three point stance for the motor assembly 77 when in all positions. The weight of the motor assembly 77 provides a considerable amount of the downward force necessary to hold the motor assembly 77 firmly referenced against the base plate 69. The hold-down spring 99 provides the remaining force to assure that the motor assembly 77 will remain in place. The positioning of the vertical axis of rotation of the pair of rollers 95 and the thickness of the spacer 115 are controlled so that the pair of rollers 95 allow the pivoting of the motor assembly 77 about the pivot pin 91 along an arcuate path within the opening 87 in the base plate 69 at all positions of the motor assembly 77 which always maintains the lower shaft extension 79 in a perpendicular relationship to the base plate 69.

The tension arm 89 (FIG. 7) projects beyond both sides of the roller bracket 93. At the end of the tension arm 89, which projects the farthest from the roller bracket 93, there is a spring anchor fitting 119 located (FIG. 6). One end of a tension spring 97 is connected to the spring anchor fitting 119 (FIG. 6) and extends toward the spindle assembly 45 substantially parallel to the base plate 69 to another spring anchor fitting 119 rigidly attached to the base plate 69.

The ability of the motor assembly 77 (FIG. 4) to pivot about the pivot pin 91 (FIG. 3) provides the necessary variation between the axis of the lower shaft 85 of the spindle assembly 45 and the lower shaft extension 79 of the motor assembly 77 so as to provide the needed variation to permit the belt 75 to be removed or installed while also automatically compensating for stretch in the belt 75. The drive pulley 71 includes a key way (not shown) which mates with a key (not shown) seated in the lower shaft extension 79 which permits the drive pulley 71 to be positioned properly on the lower shaft extension 79 when assembled to assure proper vertical pulley alignment between the drive pulley 71 and the driven pulley 73. A set screw (not shown) is provided in both the drive pulley 71 and driven pulley 73 both of which set screws are tightened when the drive pulley 71 and the driven pulley 73 are in their proper alignment.

An inverted U-bracket 124 (FIG. 5) is affixed to the upper end of the motor assembly 77. One spring 125 of the pair of hold-down springs 99 is connected at one end to an anchor fitting 127 in the U-bracket 124 and at the other end to an anchor fitting 129 in the base plate 69. This hold-down spring 125 which is connected to the U-bracket 124 is furthest from the pivot pin 91 and is located at a slight angle from the vertical and, therefore, imposes a moment about the pivot pin 91 which adds to the moment provided by the tension spring 97. This rational moment separates the drive pulley 71 on the lower shaft extension 79 from the driven pulley 73, thereby establishing the proper and constant tension on the belt or drive belt 75. Particularly, another spring 131 of the pair of hold-down springs 99, due to its generally vertical orientation, in conjunction with the weight of the motor assembly 77 assures that the motor assembly 77 is firmly held against the base plate 69 at all times, including periods of vibration that will naturally result from the use of a Centrifuge.

Figure 7:
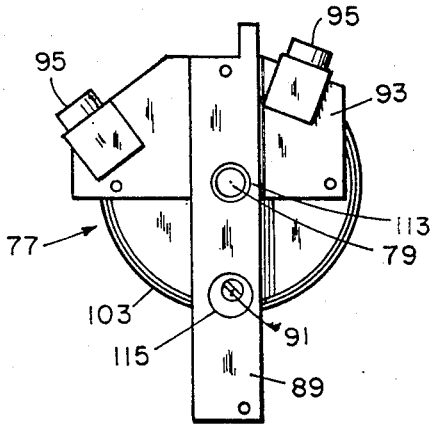
FIG. 7 is a plan view of the undersurface of the motor assembly with the belt tensioning arm in place.

In addition to providing the needed tension, the rotational moment of the two springs 97, 125 avoids the problem of a failure of the belt 75 going unnoticed. The end of the tension arm 89 adjacent to the pair of rollers 95, as best seen in FIG. 7 and FIG. 5, is shaped so as to actuate a belt switch 133 which is a snap-type switch mounted on the base plate 69, as best seen in FIG. 5.

The belt switch 133 is of the momentary contact design with a normally-closed contact. The function of the belt switch 133 is explained in the description of the electrical circuitry set forth hereinafter. Should, however, the belt 75 either stretch abnormally or break, the moment caused by the two tension springs 97, 125 will cause the motor assembly 77, and thus the drive pulley 71, to move the maximum distance from the driven pulley 73 causing the tension arm 89 to actuate the belt switch 133 thereby opening its contact. The opening of belt switch 133 deactivates the motor 103 and prevents any restarting of the motor 103 until the belt 75 is replaced.

The motor 103 (FIG. 6), which is of the induction type, is specifically designed to obtain both a starting and a braking torque in excess of two hundred thirty percent of the full load rating with a full load efficiency exceeding seventy percent at a power factor of better than ninety-eight percent. The specially designed induction motor includes a main winding as well as an auxiliary winding with an impedance ratio of unity. With this type of induction motor, capacitors are used to start and operate the induction motor and the value of the capacitors must be optimized for both the operating condition as well as the starting and braking condition. A value of capacitance for high starting and braking torque which is four times the optimum capacitance value required for the highest full load running efficiency is utilized. A switching means is provided which adjusts the capacitance value as required either for the starting and braking conditions or for the running condition.

Figure 9:
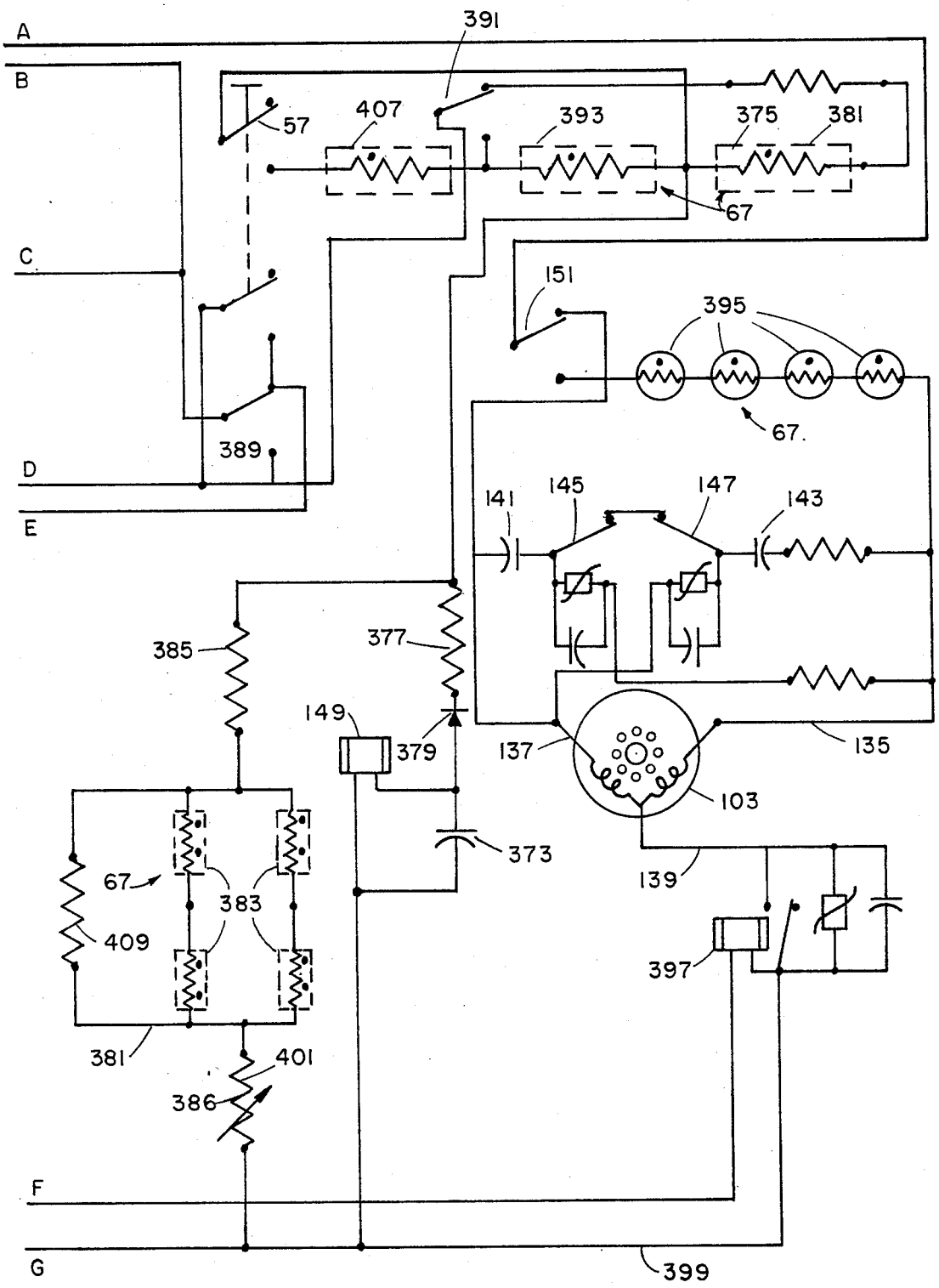
FIG. 9 is a schematic view of the remaining half of the electrical circuitry not already shown in FIG. 8 with the lines A, B, C, D, E, F and G corresponding with the same designated lines of FIG. 8.

The induction motor is provided with the three usual electrical leads, namely a black lead 135, a blue lead 137 and a white lead 139 (FIG. 9). Although these are the colors normally used, the color of the leads is not actually important, but does serve as a means of designation. The white lead 139 is usually utilized as the common connection for the windings of the motor 103. A first capacitor 141 and a second capacitor 143, both identical, and each having a typical value of fifty microfarads are provided as best seen in FIG. 9, which is the right half of the electrical schematic. A contact 145 and 147, which are part of relay 149, operate in unison. When in the deenergized state, the two contacts 145, 147 are normally closed (as shown in FIG. 9) connecting the first capacitor 141 and the second capacitor 143 in series across the non-common ends of the main and auxiliary winding via the black lead 135 and blue lead 137. The combined value of the two fifty microfarad capacitors 141, 143 is controlled by the following well-known formula:

$$\frac{(50uf)}{(50uf)} \underset{+}{\times} \frac{(50uf)}{(50uf)} = 25uf$$

The resulting reduced or half value of twenty-five microfarads is the desired value for the operating condition of the motor.

When high torque is required for the fast starting or fast braking, the relay 149 is energized thereby opening the normally-closed contacts 145 and 147. With the contact 145 and the contact 147 both in the open position, the first capacitor 141 is in parallel with the second capacitor 143 and the combined value of the two capacitors 141, 143 in parallel is controlled by the following formula:

$$(50\ \mu f)+(50\ \mu f)=100\ \mu f$$

The capacitance of one hundred microfarads is the desired value for maximum starting and braking.

The relay 149, therefore, converts the same two capacitors 145, 147 of fifty microfarads each to the desired four to one ratio needed to satisfy the starting and braking conditions, as well as the operating condition.

Figure 8:
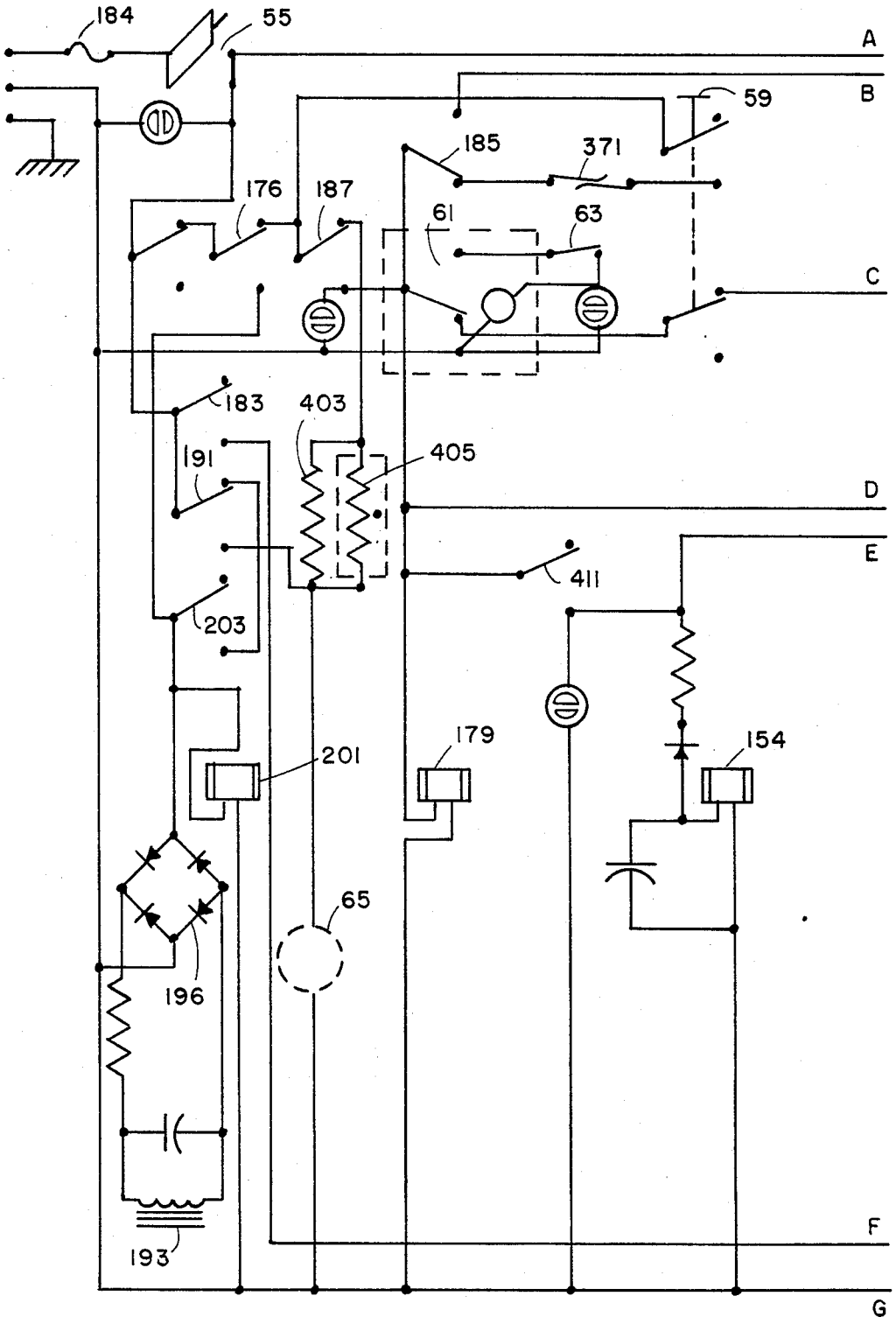
FIG. 8 is a schematic view of half of the electrical circuitry with lines A, B, C, D, E, F and G indicating connections to the other half of the wiring diagram as shown in FIG. 9.

Another contact 151, which is normally-closed (FIG. 9), controls the direction of motor torque. The contact 151 is operated by a relay 154 (FIG. 8). When the relay 154 is deenergized, the contact 151 is in the normally-closed position as shown in FIG. 9 which connects the power supply to the main winding side of the motor 103 through the blue lead 137 which in turn is connected to the two capacitors 141, 143. This connection results in clockwise rotation of the motor 103, as viewed from the upper end of the motor 103. When the relay 154 is energized, contact 151 transfers to the open position which connects the power source to the auxiliary winding side of the motor 103 through the black lead 135 which reverses the direction of torque of the motor 103 to counter-clockwise when viewed from the upper end of the motor 103.

Actuation of the relay 154 to changing the direction of torque of the motor 103 serves as a braking means but further provision has to be made for stopping rotation of the motor 103 since once zero speed is reached, the motor 103 would again return to operating speed but in the opposite or counterclockwise direction unless the motor 103 is deactivated. To prevent the motor 103 from returning to operating speed, but in the opposite direction of rotation as used for braking, a reverse detection means 156 (FIG. 5) is provided at the upper end of the motor 103.

As best seen in FIG. 5, a block 158 having a rectangular shape is mounted on the upper end of the motor 103 as a reverse detection arm 160. A cylindrical opening 162 is formed in one end of the reverse detection arm 160 and a uni-directional clutch 165 is press-fitted into the cylindrical opening 162. The clutch 165 has an internal opening 167 which is slipped over an upper shaft extension 169 of the motor assembly 77. The clutch 165 is press fitted rigidly into the reverse detection arm 160 to prevent rotation of the clutch 165 with respect to the reverse detection arm 160. Since the clutch 165 permits rotation in only one direction, the only direction of rotation which is permitted is the operational direction of rotation for the motor 103, which is clockwise when looking down at the motor 103. This direction of rotation is termed the "over-running direction" with respect to the clutch 165 and in the over-running direction the upper shaft extension 169 may rotate indefinitely. In the preferred embodiment, a clockwise rotation as viewed from looking down on the upper end of the motor 103 has been selected as the normal operational direction of rotation for the motor 103.

In the braking phase, following an operational run of the Centrifuge, while the Centrifuge is rapidly decelerating, the end of the reverse detection arm 160 remote from the upper shaft extension 169 is urged, consistent with the continued rotation of the motor 103, in a clockwise direction but to an ever-decreasing degree due to the decrease in the speed of rotation. This urging is caused by the unavoidable frictional drag of the clutch 169 even when operating in the over-running direction. However, the rotation of the reverse detection arm 160 caused by this slight frictional drag between the clutch 165 and the upper shaft extension 169 is limited by means of a stop sleeve 171 and a clearance hole 173. The clearance hole 173 is located at the end of the reverse detection arm 160 opposite from the clutch 165.

A stop switch 176 (FIG. 5) is located adjacent the end of the reverse detection arm 160 where the clearance hole 173 is located. As the rotation of the motor assembly 77 and the spindle assembly 45 reach zero speed, the upper shaft extension 169 as well as the lower shaft extension 79 of the motor assembly 77 just begins to rotate counter-clockwise in the direction opposite from the running direction of rotation. The clutch 165, however, locks the upper shaft extension 169 of the motor assembly 77 to the reverse detection arm 160 thereby moving the reverse detection arm 60 away from the stop sleeve 171 in a counter-clockwise direction causing the reverse detection arm 160 to strike an actuator button 177 on the stop switch 176 thereby de-energizing a relay 179 (FIG. 8). The actuator button 177 opposes the action of the reverse detection arm 160 by means of a spring (not shown) which forces the actuator button 177 outwardly. In turn, the contact 181 (FIG. 9) is de-energized by a contact 183 (FIG. 8) of the relay 179 which turns off the motor 103. This is a positive and fail-safe means of providing zero speed detection and a positive and safe means to stop the operation of the Centrifuge. The fact that the motor 103 and the spindle assembly 45 and rotor 33 it is driving must first reach zero speed before the stop switch 176 is actuated, assures that the motor 103 is deactivated at a virtual standstill and is not still moving at a reduced but perhaps dangerous rate of speed.

Should the clutch 165 fail by freezing fast to the upper shaft extension 169, the Centrifuge would be safe because no rotation would be possible. If the clutch 165 failed by not preventing opposite rotation, the stop switch 176 would not be opened which would prevent the opening of the access door 29 as will be subsequently explained.

In the situation where the clutch 165 freezes in place, the reverse detection arm 160 rotates a few degrees in the normal operational direction, namely clockwise, until stopped by the stop sleeve 171. Then either a fuse 184 located in the electrical circuit will open or a thermal protector in the motor 103 will open. Either event turns off the power to the motor 103.

In the alternative situation, where the clutch 165 fails to lock in the counter-clockwise direction of rotation, the rotation of the upper shaft extension 169 in either direction would be permitted and the stop switch 176 would not be actuated. Under such circumstances, the motor 103 would accelerate in the counter-clockwise direction after reaching zero speed but since the stop switch 176 would also not be actuated by the reverse detection arm 160, there would not be access to the rotor chamber as will be subsequently explained.

As to the stop switch 176, there are three possible failures as follows:

(A) Stop switch 176 jams so that its normally-open contacts remain connected after an actuation;

(B) The contact within the stop switch 176 does not travel from the normally-closed to the normally-open position upon actuation; and, (C) The stop switch 176 completely fails such that the movable contact fails to make contact with either the open terminal or the closed terminal.

Under condition (A), since the relay 179 cannot be energized, there can be no operation of the Centrifuge and, therefore, no damage can occur. Under condition (B), the Centrifuge will operate in the counter-clockwise or braking direction of rotation, but injury to the operator is not possible because the access door 29 cannot be opened. Under condition (C), the access door 29 cannot be opened and further use of the Centrifuge is not possible.

In the event the belt 75 fails, the belt switch 133 is actuated as has been previously explained. Actuation of the belt switch 133 de-energizes the relay 179, thereby shutting off the power to the motor 103. Should the belt 75 fail while the Centrifuge is operating, the motor 103 will coast to a stop since reversal of the direction of rotation of the motor 103 is impossible without electrical power but a fail-safe condition is still ensured because the access door 29 cannot be opened since the stop switch 176 cannot be actuated by the reverse detection arm 160. In the event of a momentary power interruption, whether deliberately or accidently caused by actuating of the main power switch 55 or by a failure of the power supply, a lock switch 185 which is actuated by closure of the access door 29 provides a fail-safe condition.

When initiating a normal run, the main power switch 55 is switched on. Then, the run switch 59 is momentarily depressed, which energizes the relay 179 but only if the lock switch 185, which is normally open, is closed due to the access door 29 being closed. The relay 179 closes three contacts 187, 183, 191 (FIG. 8) thereby closing the operating circuit until the circuit is broken at the end of a normal braking cycle by the actuation of the stop switch 176.

The opening of the access door 29 during a power failure when the Centrifuge is still spinning is prevented by a solenoid 193 which, when de-energized, mechanically locks the access door 29 by placing a door locking rod 195 (FIG. 1) in the path of the access door 29, thus physically preventing the access door 29 from being moved from the closed position. The solenoid 193, which requires DC power, is supplied with such power by means of bridge 196. A solenoid return spring 199 forces the door locking rod 195 upwardly preventing the access door 29 from being opened. In the absence of power, the solenoid 193 cannot withdraw the door locking rod 195 downwardly.

In order to energize the solenoid 193, the stop switch 176 must be momentarily actuated, which can only happen at the end of a normal braking cycle as previously explained. As the reverse detection arm 160 (FIG. 5) momentarily actuates the stop switch 176, the stop switch 176 leaves the normally-closed position (shown in FIG. 8) thus de-energizing the relay 179 causing the contact 191 and the contact 187 and the contact 183 to return to the non-operating position shown in FIG. 8. However, when the stop switch 176 is opened, a relay 201 is energized thereby opening the normally-closed contact 203. Even though the stop switch 176 immediately recloses, the relay 201 has been actuated and is held in an energized state through the contact 191 and the contact 203. In this manner, the solenoid remains energized withdrawing the locking rod 195, permitting the access door 29 to be slid open.

Referring specifically to the spindle assembly 45 best seen in FIG. 10, an upper shaft 205 is connected to the lower shaft 85 by means of a flexible coupling 207 formed from one piece of aluminum as an edge-wound helical spring. The driven pulley 73, as has been previously explained, is affixed to the lower end of the lower shaft 85, thus supplying the required rotation to the spindle assembly 45.

The rotor base 35 is detachably mounted to the upper shaft 205 by means of a male taper 209 on the upper end of the upper shaft 205 being set within a female taper 211 concentrically located within the rotor base 35.

A tube carrier 213, which is removable, is contained within the rotor base 35 and is further enclosed, when in operation, by the rotor cover 49. The combination of the rotor cover 49 and the rotor base 35 form the rotor 33 which is mounted on an upper shaft 205 of the spindle assembly 45.

As has been previously explained (FIG. 3), the spindle assembly 45 is secured to the base plate 69 by three bolts 81. More specifically, a lower bearing housing 215 is provided which is rigidly secured to the base plate 69 as explained. The lower bearing housing 215 includes an internal opening 217 which extends through the lower bearing housing 215 which is concentric and cylindrical. Adjacent the lowest portion of the lower bearing housing 215 is located for the lower shaft 85 and in the general midsection of the lower bearing housing 215 an upper bearing 221 for the lower shaft 85 is also located within the internal opening 217. The lower shaft 85 is rotatably mounted on the lower bearing 219 and the upper bearing 221. Above the upper bearing 221 the lower shaft 85 has an upper section 223 which is slightly reduced in diameter. This upper section 223 of reduced diameter fits into the flexible coupling 207. An access opening 225, located at an acute angle to the diameters of the flexible coupling 207 and the lower bearing housing 215 extends through the lower bearing housing 215 to permit access to a lower set screw 227 in the flexible coupling 207. The lower set screw 227 which is also located at an acute angle to the diameters of the flexible coupling 207 and the lower bearing housing 215, when tightened down, secures the flexible coupling 207 to the upper section 223 of the lower shaft 85.

The upper shaft 205 is also secured to the flexible coupling 207 at the lower end of the upper shaft 205 by means of an upper set screw 229 in the flexible coupling 207 but no access opening is required for the upper set screw 229 since the flexible coupling 207 is placed in lower bearing housing 215 after it is tightened down on the lower end of the upper shaft 205.

An upper bearing housing 231 is located at the upper end of the lower bearing housing 215 by means of an elastomeric gasket 235 having a U-shaped cross-section not unlike an automobile tire which includes a main vertical portion 237 and two short horizontal protrusions 239, each extending from opposite ends of the main vertical portion 237. The lower protrusion or bead 241 of the soft gasket or "tire" fits beneath the upper bearing housing 231 while the upper protrusion 243 is fitted into a groove 245 in the upper bearing housing 231. The soft rubber gasket 235 is thus affixed to the outside surface of the lower end of the upper bearing housing 231.

The upper end of the internal opening 217 in the lower bearing housing 215 has an enlarged diameter in comparison to the rest of the internal opening to permit the elastomeric or soft rubber gasket 235 to fit into the lower bearing housing 215. Where the diameter of the internal opening 217 increases to the enlarged diameter of the upper end to adapt to the elastomeric soft rubber gasket 235, a cylindrical ledge 247 is formed and a height adjustment washer 249 is located between the ledge 247 and the elastomeric gasket 235.

The upper bearing housing 231 also has an internal opening 251 which is both cylindrical and concentric. Within the internal opening 251 of the upper bearing housing 231, there is located an upper bearing and a lower bearing. The upper shaft is rotatably mounted on both the upper bearing 253 and the lower bearing 255 within the upper bearing housing 231.

The upper end of the upper shaft 205, as has previously been mentioned, is tapered, having a continuously decreasing diameter with the upper end having the least diameter of the entire upper shaft 205. Adjacent to, but below the lower end of the taper, a cross pin 257 is located. The rotor base 35 is mounted, as seen in FIG. 10, upon the upper end of the upper shaft 205 by means of an adapter 43 having a concentric opening with the mating female taper 211 to assure concentric rotation of the rotor base 35 with respect to the spindle assembly 45. The adapter 43 is secured permanently to the rotor base 35.

One important and highly beneficial feature of the invention is the ability to remove the entire rotor 33 from the spindle assembly 45 with the tube carrier 213 within the rotor 33 and with the rotor cover 49 and the rotor base 35 sealed together. In order to remove the closed rotor 33 from the upper shaft 205, an opening 259 is concentrically located through the rotor cover 49. The bolt 47 is threaded concentrically into the tapered end of the upper shaft 205 through the adapter 43. A suitable wrench (not shown) can be readily inserted through the opening 259 and the bolt 47 is rotated counter-clockwise so as to turn upwardly out of the end of the upper shaft 205. Once the bolt 47 has extended only a short distance, it strikes the base of the release mechanism 263 for the cover which mechanism is to be subsequently explained. In this manner, the entire rotor assembly is forced off the spindle assembly 45, with the rotor cover 49 remaining attached and sealed to the rotor base 35.

One of the other benefits of the invention is the inclusion of a rotor cover 49 to seal the sample tubes within a rotor 33 while providing the ability quickly to remove the rotor cover 49 for loading or unloading of samples.

The rotor cover 49 includes a grip sleeve 265, which is concentrically located on and extends upwardly from the top of the rotor cover 49. The upper end of the grip sleeve 265 is flared to provide a place for the operator's index and middle fingers while the thumb is used to push downward on a release button 267. A groove 269 which is circumferential is located in the outer periphery of the release button 267. As the release button 267 is pushed downwardly, a series of locking balls 271 become aligned with the groove 269 in the release button 267. The locking balls 271, typically six in number, are located near the top of the rotor cover 49 and within clearance holes 273 disposed radially within an inner sleeve 275. The inner sleeve 275 is slidably mounted within an outer sleeve 277. The outer sleeve 277 is threaded into the grip sleeve 265. A magnet 279 is press-fitted into the top of the release button 267. The locking balls 271 are urged inwardly by angled flanks 281 in ball groove 283 in the outer sleeve 277 which registers with the clearance holes 273 disposed in the inner sleeve 275. The depth of the groove 269 in the release button 267 is sufficient that the locking balls 271, once urged out of the ball groove 283, lie within the outside diameter of the inner sleeve 275. Since the outer sleeve 277 and the inner sleeve 275 are slidably mounted in relationship to one another, the outer sleeve 277, with the grip sleeve 265, will be drawn upwardly by the pulling action of the operator's fingers, opposed by the downward pressing of the operator's thumb on the release button 267.

The outer sleeve 277 has an enlarged diameter or counterbore 285 at its upper end. At the upper end of the inner sleeve 275 is a retaining ring 287 secured into a groove 289 on the outside circumferential surface of the inner sleeve 275. The counterbore 285 provides clearance space for the retaining ring 287. However, as the outer sleeve 277 moves upwardly in relation to the inner sleeve 275, the bottom of the counterbore 285 strikes the retaining ring 287, thereby preventing further axial movement between the inner sleeve 275 and the outer sleeve 277.

As has been previously stated, a male taper 209 at the end of the upper shaft 205 fits within a female taper 211 in an adapter 43 located within the rotor base 35.

As seen in FIG. 10, the adapter 43 is slidably fitted inside the inner sleeve 275 and is press-fitted into the rotor base 35. The adapter 43 includes a circumferential ridge or enlarged diameter section 291 near its lower end and the rotor base 35 rests upon that enlarged diameter section or circumferential ridge 291.

Housed within clearance holes 293 disposed radially near the bottom of the inner sleeve 275 are a series of locking balls 295, typically six in number which are similar to the clearance holes 273 and locking balls 271 located above them on the inner sleeve 275. Prior to the upward movement of the outer sleeve 277, these locking balls 295 are located as shown in FIG. 10, thereby locking the inner sleeve 275 to the adapter 43. However, as the outer sleeve 277 reaches its upper limit of travel, as explained, with respect to the inner sleeve 275, a counterbore 297 in the lower end of the outer sleeve 277 becomes aligned with the locking balls 295, thereby resulting in the locking balls 295 moving radially outwardly until the locking balls 295 are entirely outside the inner diameter of the inner sleeve 275 and into the counterbore 297 at the lower end of the outer sleeve 277.

With the locking balls 295 thus disengaged from the adapter 43, the entire rotor cover 49, including the release mechanism 263 within it, is free of the rotor base, permitting the rotor cover 49 to be removed from the rotor base 35, and thereby providing access to the tubes in the tube carrier within the rotor body.

Refitting of the rotor cover 49 is accomplished by grasping the grip sleeve 265 and depressing and holding the release button 267 depressed with the operator's thumb throughout the refitting of the rotor cover 49. As the adapter 43 enters the inner sleeve 275, a chamfer or bevel 299 located at the upper outside edge of the adapter 43 gradually forces the locking balls 295 radially outwardly into the clearance holes 293 at the lower end of the inner sleeve 275 and partially into the clearance space provided by counterbore 297 when the outer sleeve is raised with respect to the inner sleeve. Further downward force on the button 267 pushes inner sleeve 275 to its most downwardly position where the lower end of inner sleeve 275 is stopped by a ledge 300 on adaptor 43. Locking balls 295 are now vertically aligned with a groove 296 in adaptor 43, allowing outer sleeve 277 to move downwards force locking balls 295 into groove 296, which locks inner sleeve 275 and, hence, entire cover is in position. The release button 267, however, remains depressed because the lock balls 271, disposed at the upper end of the inner sleeve 275, are trapped in the groove 269 in the release button 267, thereby retaining the release button 267 in a downwardly position. Therefore, to lock the rotor cover 49 in position, downward pressure is applied to either the grip sleeve 265 or to the top surface of the rotor cover 49. The rotor cover 49 has a lower flared lip 301 which presses against an O-ring or seal 303. The downward pressure on the grip sleeve 265 or top surface of the rotor cover 49 causes the lower flared lip 301 of the rotor cover 49 to contact the seal 303 and further downward pressure causes the top surface of the rotor cover 49 to flex just slightly to a concave condition as the groove 269 and the locking balls 271 come into vertical alignment. The upward force of a return spring 305 beneath the release button 267 and the angled flank of the groove 269 in the release button 267 gradually forces the locking balls 271 outwardly partially through the clearance holes 273 in the inner sleeve 275 and into the outer sleeve 277.

Once the locking balls 271 are in place, the release button 267 is forced back to its uppermost position which is notably above the top surface of the inner sleeve 275 and offers positive visual proof that proper latching has occurred.

The rotor cover 49 is secured to the outer sleeve 277 being secured between the grip sleeve 265 and a locking sleeve 307. The locking sleeve 307 is threaded to the outer sleeve 277 in the same manner that the grip sleeve 265 is threaded to the outer sleeve 277. Since both the locking sleeve 307 and the grip sleeve 265 are threaded to the outer sleeve 277, the axial position of the rotor cover 49 may be adjusted vertically with respect to the outer sleeve 277 so that the desired amount of concavity, and hence, spring loading of the top surface of the rotor cover 49 may be achieved. When properly adjusted, a force of five to ten pounds is exerted by the rotor cover 49 on the seal or O-ring 303 as the rotor cover 49 tends to return to a flat condition. In this manner, the rotor cover 49, which is fabricated from a heat-heated alloy so as to have the required spring properties, provides the force necessary to load the seal 303 and prevent leakage.

One of the features of the invention is the use of the removable tube carriers 213 which can be alternatively placed in the rotor base 35 to provide a multiplicity of various size sample tube receptacles 311, each optimized to carry a maximum number of sample tubes 313 of a given diameter and length at maximum radius and each configured to place the closed end of a particular length of sample tube 313 at its maximum spin radius. Each sample tube 313 is held by a circumferential lip molded at the filler neck of the tube within a sleeve 315 which is part of the sample tube carrier 213. Each of the different sample tube carriers 213 are of the same outward dimension to fit within the rotor base 35 as best seen in FIG. 10. In this way, a selection of sample tube carriers 213 are made available to the operator at a minimum of expense. Consequently, only one rotor base 35 and rotor cover 49 are required.

Referring now to FIG. 10, one possible arrangement of sample tubes 313 is shown where twenty-four sample tubes 313 are located in two circular and concentric rows of twelve tubes each with an outer row of sleeves 315 located further up the wall of the rotor base 35 than an inner row of sleeves 315. More specifically in the arrangement shown in FIG. 10, the sleeves 315 are spaced thirty degrees apart in each row, with the entire pattern of sample tube receptacles 311 in one row shifted fifteen degrees with respect to the other row. The length of the sleeves 315 in the outer row are increased so that the closed or lower ends of the sample tubes 313 are located at the maximum radius in both the inner row and the outer row to achieve equal and maximum centrifugal force for each sample tube 313 regardless of position of the sample tube 313 within the tube carrier 213. A payload of twenty-four sample tubes 313 represents a one hundred percent increase over the most usual designs now available.

Another widely used sample tube 313 has approximately half the diameter of the 1.5 ml tube contemplated for use in the previous example. The reduced diameter of each sample tube 313 allows the spacing between adjacent receptacles 311 to be reduced typically to twenty degrees, resulting in a capacity of thirty-six of such smaller diameter sample tubes 313 for the removable tube carriers 213. Previously, smaller diameter sample tubes 313 would be supported within adaptor bushings placed in the tube sleeves 315 which were sized to accommodate a sample tube 313 of the largest diameter.

When such an adapter bushing was used, the payload would remain at twelve sample tubes. Since the volume of each sample tube 313 would have decreased typically from 1.5 ml to 0.4 ml, the total payload would have decreased to 26.6% based upon a total sample tube load of 18 ml being used as a comparison base.

Figure 12A:
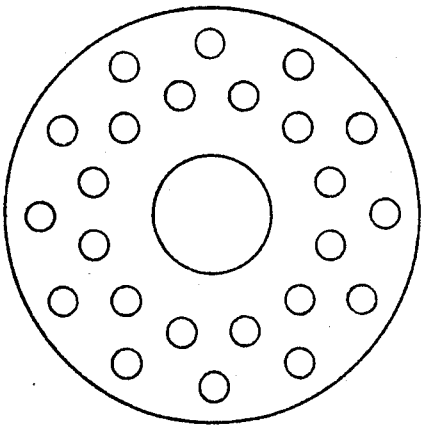
FIGS. 12A through 12W are a series of plan views each having twenty-four places within a two-row carrier and showing twenty-three different loading arrangements with the loaded space or spaces filled and the non-loaded spaces are open from zero places filled to twenty-four places filled.
Figure 12B:
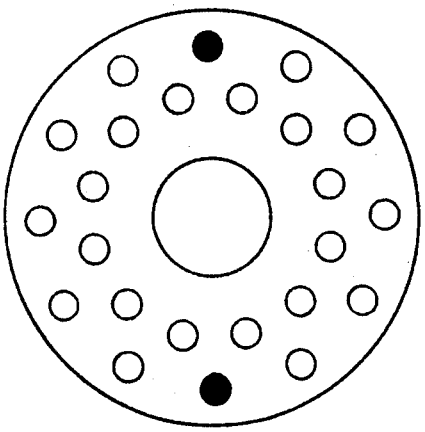
Figure 12C:
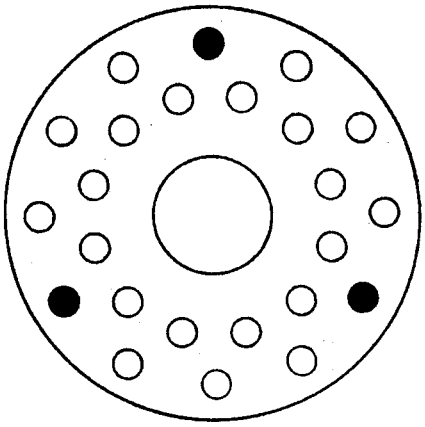
Figure 12D:
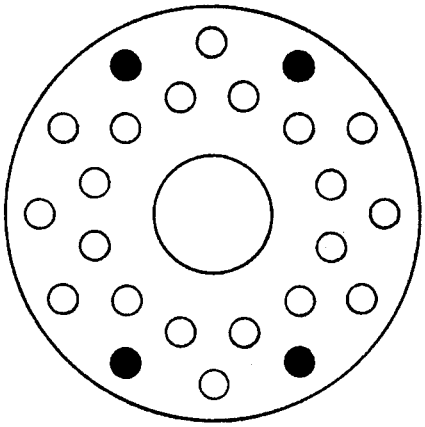
Figure 12E:
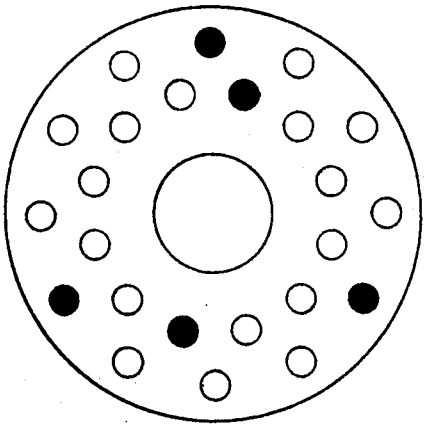
Figure 12F:
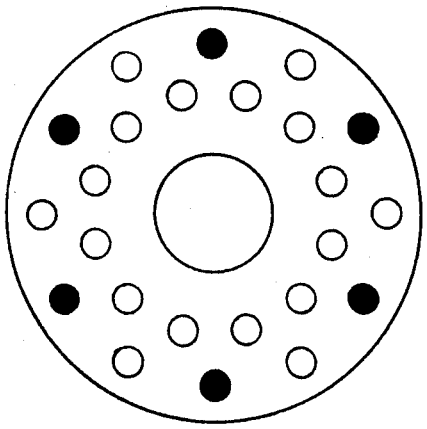
Figure 12G:
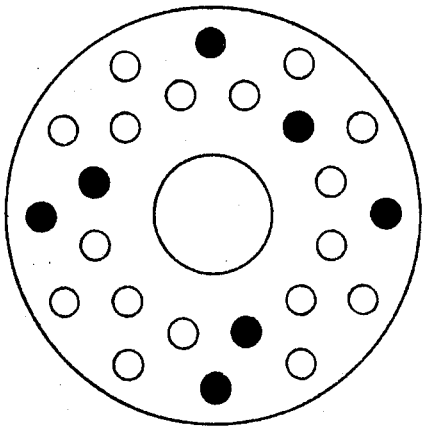
Figure 12H:
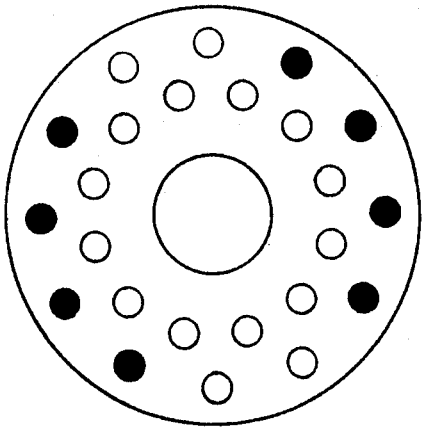
Figure 12I:
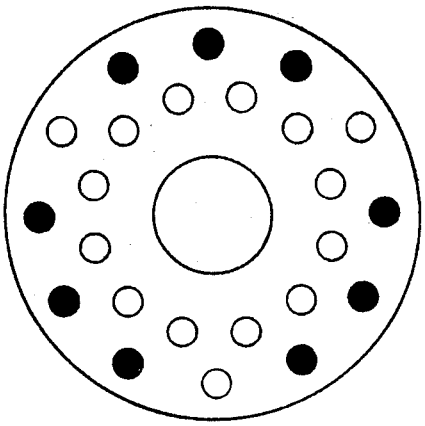
Figure 12J:
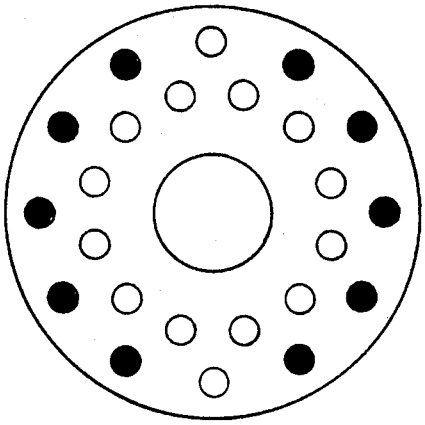
Figure 12K:
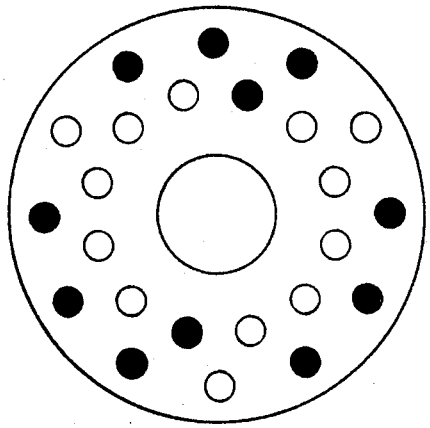
Figure 12L:
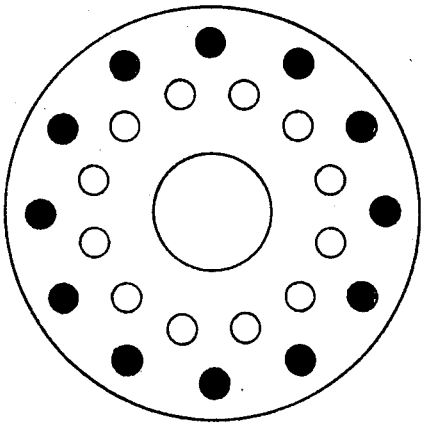
Figure 12M:
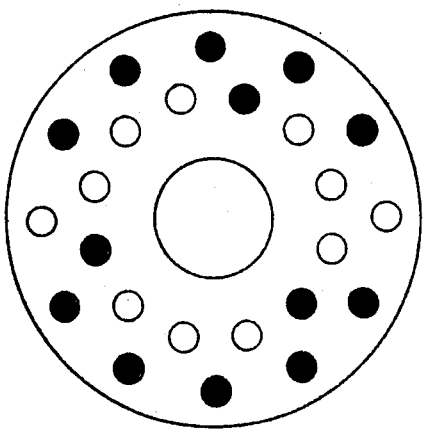
Figure 12N:
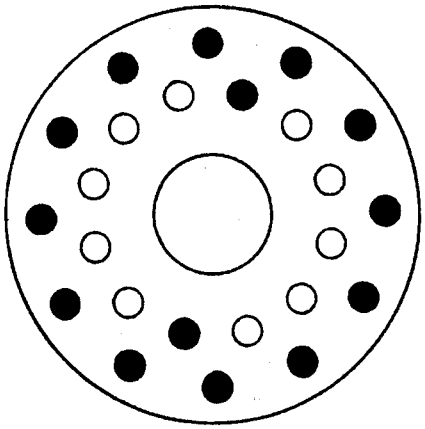
Figure 12O:
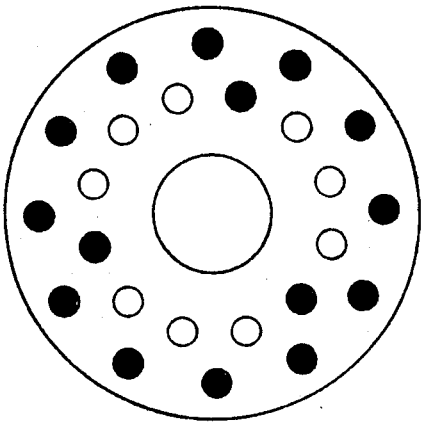
Figure 12P:
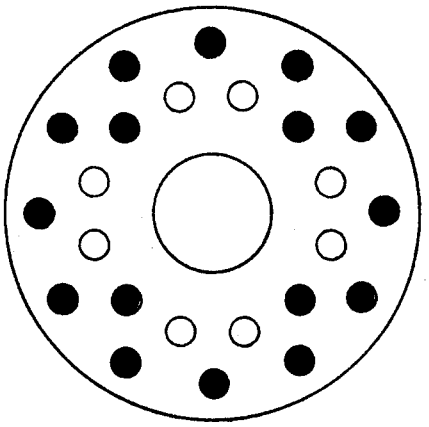
Figure 12Q:
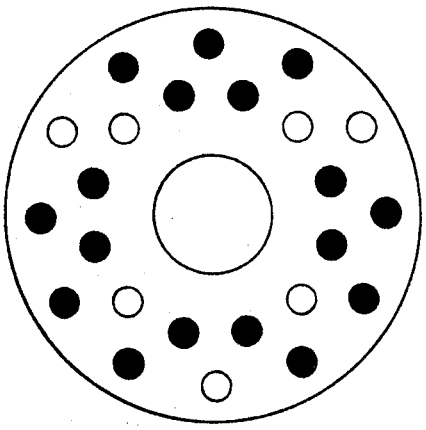
Figure 12R:
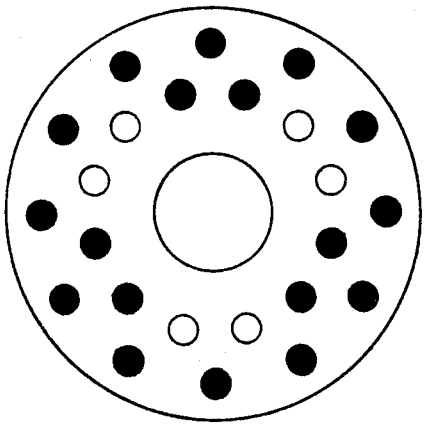
Figure 12S:
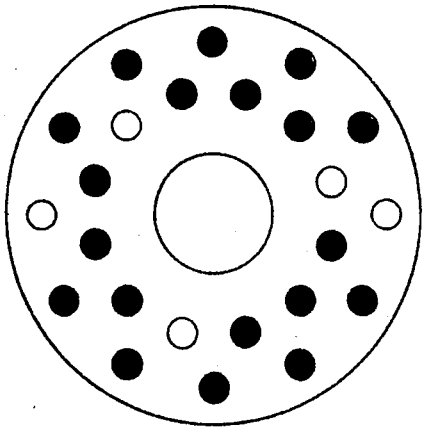
Figure 12T:
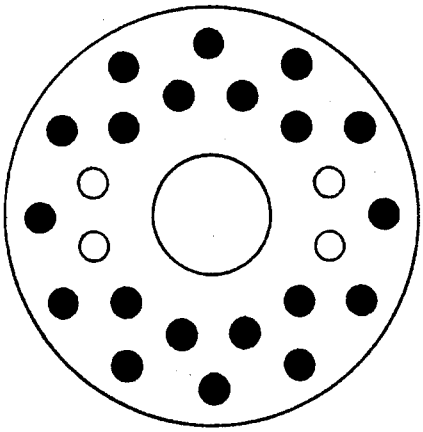
Figure 12U:
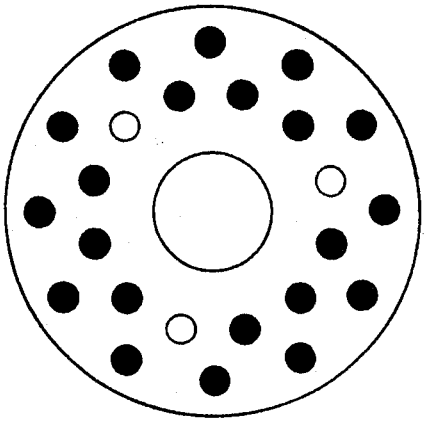
Figure 12V:
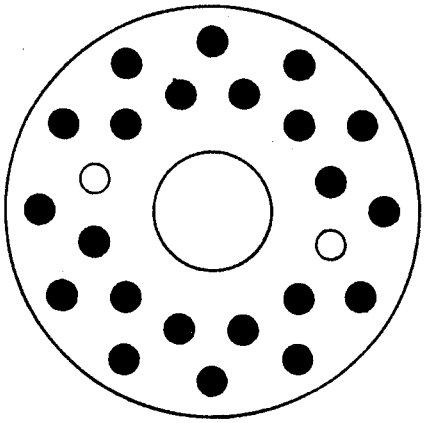
Figure 12W:
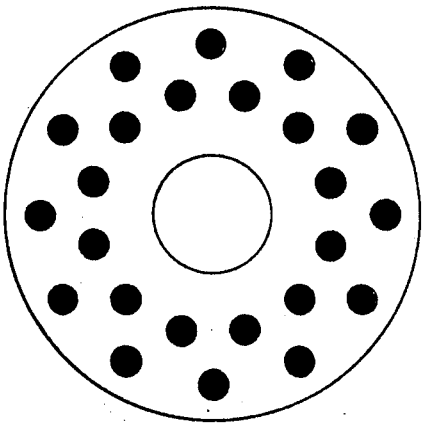

An important feature of the removable tube carriers 213 is the capability to have two rows of tubes permit a large number of sample tube loadings, such as twenty-four tubes without the necessity for a rotor 33 with a large diameter with the resultant windage drag, inertia and added time for acceleration and deceleration as well as excessive motor torque. A clear understanding of loading a two-row carrier 213 can be most easily understood by reference to FIG. 12. The sample tube receptacles 311 are arranged, as seen in FIG. 10 and in FIGS. 12A through 12W, in two concentric circular rows of twelve tube receptacles each. With the exceptions of only one sample tube 313 and twenty-three sample tubes 313, there is permissable loading for any number of sample tubes 313 from one through twenty-four. The permissable ratio thereby achieved with this double-row configuration is 22/24=91.6%. By this means, the the operator is afforded almost unlimited choice to process the exact number of sample tubes 313 desired without having to use so-called "dummy tubes" to achieve rotor balance. Such "dummy" tubes are a nuisance and do not represent useful payload.

An important feature of the configuration of the sample tube carriers 213 is the ability for the operator to load or unload sample tubes 313 while the removable tube carrier 213 is mounted in the rotor base 35 or to perform such loading and unloading with the removable tube carrier 213 removed to a work area where the removable tube carrier 213 would serve as a tube holding rack prior to processing.

With all centrifuges, spills within, whatever serves as a rotor base 35, are inevitable. The removable tube carrier 213 makes possible ready cleaning of the rotor base 35 and also eliminates the high inertial mass of tube holder of the monolithic design.

The clearance space between the outside ends of the tube carrier sleeves and the inside diameter of the rotor body is usually kept small (typically 0.005 inch) but is always sufficient to allow easy withdrawal of the removable tube carrier 213 from the rotor base 35 after the removal of the rotor cover 49. With smaller-sized sample tubes 313, the sleeves 315 may be shorter, with the inherent strength and rigidity of the carrier sufficient to support the sample tubes without need for the load bearing capabilities of the outside cylindrical portion or vertical wall 37 of the rotor body 35. A concentric location of the removable tube carrier 213 is assured by the close tolerance between removable tube carrier 213 and the hub of the rotor base 35. A frictional bushing prevents the removable tube carrier 213 from rotating within the rotor body during acceleration and braking. When the rotor 33 begins to accelerate, centrifugal force acting on removable tube carrier 213 tends to deflect the sleeves 315 radially outwards. If the rotor 33 revolves at a sufficiently high rate of speed, the ends of sleeves 315 may actually contact the inner wall of rotor base 35. Under such circumstances, further outward deflection of the sleeves 315 holding the sample tubes 313 is at that point restricted so that as the rotational speed increases, the sleeves 315 exert loading on the wall of the rotor base 35. The radially outwardly directed forces of the sleeves 315 thereby loads the rotor base 35, placing the wall of the rotor base 35 in tensile or hoop stress. It is therefore, essential that the rotor base 35 be constructed of material capable of accepting this loading without harm. Since the elastic limits of deflection are therefore not exceeded, the removable tube carrier 213 will restore the small outside diameter clearance necessary to remove the sample tube carrier 313 as the rotor 33 decelerates to a zero speed of rotation.

In the same manner, the tip of the sample tubes 313 are supported by the cylindrical portion 37 of the rotor base 35 following small predetermined deflection of the sample tubes 313 thus preventing excessive deformation and possible rupture of the sample tubes 313.

As seen in FIG. 10, the rotor cover 49 has a flared lip which presses against the top edge of the rotor base 35 where the O-ring 303 is located. During operation of the centrifuge, the accidental breakage of a sample tube 313 can occasionally occur. In this situation, the test fluid from the sample tube 313 will be forced against the interior of the rotor 33 and might possibly penetrate the O-ring 303.

Figure 11:
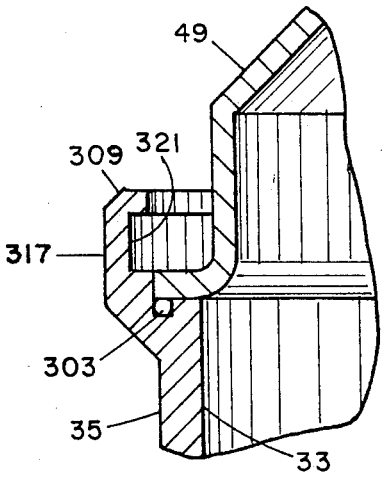
FIG. 11 is a partial cross-sectional view of the rotor showing an optional seal for the rotor cover including a spill trap to hold any fluid from broken test samples which might leak through the O-ring seal.

Accordingly, as seen in FIG. 11, an alternate version of the rotor base 35 and rotor cover 49 is shown An extension 317 of the rotor base 35 extends vertically above the seal 303 and a lip 319 extends horizontally from the top of the extension over the seal 303 and inwardly toward the rotor cover 49. In this way, a spill trap 321 is formed by the extension 317 and the lip 319 to retain any leakage which might seep through the seal 303 up to the predetermined hold-up volume of the spill trap 321.

The centrifuge, according to this invention, cannot be operated whether for a short spin or for a predetermined longer interval, if any conditions exist as follows:

(1) The rotor 33 is missing or not properly seated on the spindle assembly 45.

(2) The rotor cover 49 is missing.

(3) The rotor cover 49 is seated but is not latched.

(4) The rotor cover 49 is fully-seated but the release mechanism 263 is not fully latched.

(5) Access door 29 (FIG. 1) is not slid to the forwardmost or closed position.

Again referring to FIG. 10, in the first condition, a slot 367 in the adaptor 43 would not be aligned with the cross-pin 257 and the lower end of the adaptor 43 would rest atop the cross-pin 257 causing the rotor 33 to rest in a position approximately 5/32 of an inch higher than if the adaptor 43 was properly seated on the spindle assembly 45. With this condition, the lower front edge of the handle 27 of the access door 29 (FIG. 1) will strike the grip sleeve 265, preventing the access door 29 from being closed. Since the lock switch 185 for the access door 29 (FIG. 8) is in the normally-closed position, operation of the centrifuge is inhibited.

Under condition 2, when the rotor cover 49 is properly seated and latched, the magnet 279 located at the top of the release button 267 lies directly below and in close proximity to a rotor sensor switch 371 (FIG. 8). When the access door 29 is moved to the closed position, the rotor sensor switch 371, which is magnetically actuated and which is normally open, will close, permitting the centrifuge to operate. Should the rotor cover 49 be left off, the magnet 279 in the release button 267 which is part of the rotor cover 49 will also be missing, and thus, will not actuate the rotor sensor switch 371 so operation is not possible because the rotor sensor switch 371 is open and depression of the run switch 59 will not energize the relay 179.

In condition 3, the rotor cover 49 is properly seated, but latching is not complete since the downwards push on the grip sleeve 265 has not taken place causing the release button 267 to remain in the depressed position. Since the rotor sensor switch 371 has a definite range of actuation, the magnet 279 must be positioned within a predetermined distance from the rotor sensor switch 371 in order for the magnetic flux of the magnet 279 to close the normally-opened rotor sensor switch 371. With the release button 267 retained in the depressed position, due to incomplete latching of the rotor cover 49, the magnet 279 located in the top of the release button 267 is too far below the rotor sensor switch 371 to actuate the rotor sensor switch 371 to the closed position thereby making operation of the centrifuge impossible. Following a final push on the grip sleeve 265 or the top surface of the rotor cover 49 to complete the latching of the rotor cover 49, the release button 267 is forced upwardly approximately the required 5/32 of an inch, placing the magnet 279 within range of the rotor sensor switch 371 which causes the rotor sensor switch 371 to close so that operation is possible.

In the fourth condition described above, the rotor cover 49 is latched by the release button being located in its upward position but the rotor cover 49 is not properly seated. With the latched rotor cover 49 merely placed in the position over the adaptor 43 but not seated, the rotor cover 49 may appear to be ready for operation but not actually be safe if actuated. Just as in the first condition, the grip sleeve 265 is positioned some 5/16 of an inch above the proper height for operation and the handle 27 of the access door 29 therefore strikes the grip sleeve 265 preventing the access door 29 from closing. In this way, the magnet 279 cannot be positioned so as to close the rotor sensor switch 371.

In the fifth condition, the access door 29 (FIG. 1) is not slid to its forwardmost or closed position, preventing it from being in its run condition. By means of the access door lock switch 185 (FIG. 8) being in the state opposite that shown in FIG. 8, operation is prevented.

Providing the above five conditions are met, the automatic short spin cycle is begun by momentarily depressing the run switch 59, after setting the timer 61 to zero. Current is supplied to a capacitor 373 (FIGS. 8 and 9) via temperature sensitive element 375, fixed resistor 377 and diode 379. The capacitor 373 thereby begins to charge from its previously discharged state.

At the same time, a voltage divider 381 consisting of the temperature sensitive element 375, a series/parallel combination of temperature sensitive elements 383, and two resistors 385, 386 are energized.

The energizing of the torque boost relay 149 is delayed approximately 500 milli-seconds by the charging time constant factor of the fixed resistor 377 and the capacitor 373. This half second delay allows the motor 103 to begin accelerating gently and smoothly at low torque which minimizes the shock to the motor assembly 77, drive pulley 71, driven pulley 73 and belt 75 and the spindle assembly 45. After this brief delay, the torque boost relay 149 is energized which opens contact 145 and contact 147, thereby placing the first capacitor 141 and the second capacitor 143 in parallel with one another across the blue lead 137 and the black lead 135. This provides the 100 μf capacitance needed for maximum torque and acceleration rate.

Initially, temperature sensitive element 375 is at ambient temperature, of approximately 20° centigrade, with a resistance value of approximately 120 ohms. The temperature sensitive element 375 is a device whose resistance is a function of device temperature. At typically 120° C., the resistance of the temperature sensitive element 375 becomes extremely temperature dependent with a large positive temperature coefficient and with the terminal resistance increasing at a rate as high as 60 percent per °C. temperature change as the temperature of the temperature sensitive element 375 reaches the so-called "Switching" temperature. The series parallel combination of temperature sensitive elements 383 and resistor 385 and resistor 386 have ohmic value which are chosen so as to establish an initial current flow through the temperature element 375 which causes the temperature sensitive element 375 to so increase in temperature that the switching temperature of 120° C. is reached within approximately seven seconds of actuating the run switch 59.

When torque boost relay 149 is first energized, contact 389 associated with torque boost relay 149 is transferred to the normally-open position, thus preventing relay 154 from being energized by the voltage available from the normally-closed contact of timer 61 via the normally-closed contacts of the run switch 59. After the approximate seven-second torque boosted acceleration phase provided by the heating of the temperature sensitive element 375 to the switching point, the voltage at the upper end of the fixed resistor 377 is so diminished by the increase of the temperature sensitive element 375 that the capacitor 373 discharges to the point whereupon torque boost relay 149 de-energizes. As contact 389 associated with the torque boost relay 149 transfers back to the normally-closed position, the relay 154 is energized.

This causes the contact 391 associated with relay 154 to transfer to the normally-open position which replaces the temperature sensitive element 375 in the voltage divider 381 with another temperature sensitive element 393 which is an identical component with the temperature sensitive element 375. However, the newly-energized temperature sensitive element 393 has been de-energized for a sufficient time period to have cooled approximately to ambient temperature and thus has returned to a resistance value of approximately 120 ohms.

Once again, the torque boost relay 149 energizes thereby placing the first capacitor 141 and the second capacitor 143 in parallel for maximum torque. However, as in the starting phase, the torque boost relay 149 is delayed for a half of one second by the charging time of the capacitor 373 and the resistor 377 thereby reducing the initial shock of torque reversal. This time, however, the contact 151 associated with relay 154 has transferred to the normally-open position which connects the 115 volts alternating current power line to the black lead 135, thereby causing the motor 103 to develop strong counter-torque and the motor 103 along with the rotor 33 begin to decelerate rapidly.

A series of four temperature sensitive elements 395 characterized by a steep negative temperature coefficient are placed in series with the black lead 135 which is the auxiliary winding of the motor 103. At ambient temperature, each of the four temperature sensitive elements 395 has a resistive value of approximately five ohms, thus placing twenty ohms of resistance in series with the auxiliary winding of the motor 103. This amount of resistance is significantly greater than the motor impedance, and thus limits the magnitude of current to the motor 103 when the torque is reversed and braking begins, thereby achieving a corresponding reduction in motor torque as well as the shock impulse transmitted to the rotor 33.

When the torque boost relay 149 is energized for the braking phase and the contact 145 and the contact 147 transfer to the open position to place the first capacitor 141 and the second capacitor 143 in parallel, the current level to the motor 103 increases. This increased current level rapidly heats the four temperature sensitive elements 395 thereby reducing the resistance value of each the temperature sensitive elements 395 to approximately 0.1 ohm which is negligible compared to the impedence of the motor 103. In this way, during the brief period of heating, the shock of the reverse torque is minimized thereby preventing damage to the centrifuge as well as preventing a disturbance to the material being separated by the centrifuge.

Just as the temperature sensitive element 375 initially activated was subject to self-heating in the accelerating phase, the other temperature sensitive element 393 now is self-heating in the braking phase. Within approximately six seconds, the temperature sensitive element 393 reaches the switching temperature which de-energizes the torque boost relay 149 and once again connects the first capacitor 141 and the second capacitor 143 in series which reduces the braking torque approximately to twenty-five percent of maximum braking torque just prior to the motor 103 reaching zero speed. The motor 103 then continues to decelerate gently as zero speed is reached.

Since the torque of the motor 103 is counter to the running direction, the motor 103 attempts to reverse direction. As this happens, the undirectional clutch 165 locks and causes the reverse detection arm 160 to rotate approximately two degrees to actuate the stop switch 176. This action de-energizes the relay 79 and the relay 154 and momentarily energizes the relay to the normally-closed position which turns off electrical power to a contactor 397 which de-energizes the motor 103 via contact 181.

With the motor 103 de-energized, the restoring force of the spring 178 which forces outwardly the actuator button 177 of the stop switch 176 is sufficient to urge the reverse detection arm 160 to a neutral position away from the stop switch 176. The stop switch 176 is then left in the normally-closed position in readiness for a new cycle. As explained previously, the relay 201 is energized during the momentary actuation of the stop switch 176 and is held energized by the closing of the normally open contact 191 and also energizes the solenoid 193 to permit opening of the access door 29.

With the relay 179 de-energized, electrical power is disconnected to the motor 103 and the contactor 397 is deenergized as is the voltage divider 381. The temperature sensitive element 393 immediately beings to cool due to the flow of air from the cooling fan 65. The cooling of the various temperature sensitive elements 375, 383, 393, 395 thermally resets the circuit in preparation for the next operating cycle.

Having considered the short-spin cycle, the continuous run cycle of the centrifuge will be described. Portions of the two operations are identical.

With particular reference to FIGS. 8 and 9, the electrical power is applied for continuous operation by turning on the main power switch 55. The timer 61 is set to a value other than zero and the interval timer control switch 63 is placed in the continuous run position which is opposite from that shown in FIG. 8, thereby making possible the continuous operation of the centrifuge.

With the controls thus set for continuous operation, rotation of the rotor 33 is initiated by pressing the run switch 59. The lock switch 185 and the rotor sensor switch 371 are interlock or safety switches which must be closed to begin operation. Providing the lock switch 185 and the rotor sensor switch 371 are in the position shown in FIG. 8, the relay 179 is energized and is maintained as energized by means of contact 187 after the run switch 59 is released. The motor contactor 397 is energized by means of contact 183 of the relay 179. The white lead 139 of the motor 103 is connected to a neutral power line 399, via contact 181 of relay 397, energizing the motor 103 which begins to accelerate for an instant with a low torque because the first capacitor 141 and the second capacitor 143 are series connected, thus having an equivalent value of twenty-five microfarads.

When the relay 179 is energized, line voltage is applied to the voltage divider 381 which includes the temperature sensitive element 375 for which the resistance is typically one hundred twenty ohms at room temperature or approximately twenty-five degrees centigrade (25° C.). With the temperature sensitive element 375, having a resistance of one hundred twenty ohms at room temperature, sufficient voltage is applied to the fixed resistor 377 to energize the torque boost relay 149. However, the energizing of the torque boost relay 149 is delayed by approximately a half second by the charging time constant of the fixed resistor 377 and the capacitor 373. This approximate half second delay allows the motor 103 to begin accelerating gently and smoothly with a very low torque.

When the torque boost relay 149 is energized, the contact 145 and the contact 147 are transferred to normally-open state which causes the first capacitor 141 and the second capacitor 143 to be connected in parallel across the motor 103, providing a capacitance value of one hundred microfarads.

In view of the parallel combination of the first capacitor 141 and the second capacitor 143,as has been previously explained, the motor 103 will accelerate with a maximum torque output. During this acceleration phase, the temperature sensitive element 375 begins to heat due to the current in the voltage divider 381. The heating rate of the temperature sensitive element 375, as is well-known, is a function of the current value squared times the resistance of the temperature sensitive element 375. The value of the current, of course, is adjusted by means of an adjustable resistor 401 so that the temperature sensitive element 375 heats to an inherent switching temperature of approximately one hundred twenty degrees centigrade in a timing interval which is equal to the desired period of maximum torque. This interval is selected based upon the load to be driven and the inertia characteristics thereof. The interval of maximum torque is selected by an adjustment of the adjustable resistor 401, which should not need further adjustment unless the load characteristics are substantially altered. For a high inertia micro-centrifuge rotor, a maximum torque interval between six and seven seconds is optimum. As the temperature sensitive element 375 heats to the switching temperature, the resistance of the temperature sensitive element 375 increases dramatically with a rate as high as sixty percent for each degree centigrade of temperature increase.

Due to the increase in the resistance of the temperature sensitive element 375, the torque boost relay 149 is de-energized causing the contact 145 and contact 147 to revert to their normally-closed position which again connects the first capacitor 141 and second capacitor 143 in series, reducing their combined value to twenty-five microfarads, thus providing the optimum capacitance value for continuous operation of the motor once the motor has reached operational speed.

To initiate a stop, brake switch 57 is momentarily depressed thereby energizing the relay 154. At that point, the contact 391 transfers to the normally-open state, thereby deenergizing the temperature sensitive element 375 while energizing the temperature sensitive element 393 in the voltage divider 381 and, at the same time, the contact 151 transfers electrical power from the blue lead 137 to the black lead 135. The temperature sensitive element 393 is identical to the temperature sensitive element 375 and is cooled to near-ambient temperature from any recent previous braking cycle by the operation of the cooling fan 65. The temperature sensitive element 393 immediately begins to heat in the same manner as did the temperature sensitive element 375 during the acceleration phase. With the contact 151 transferred to the normally-open state, the motor 103 provides a relatively smooth two-stage reversal of torque. A series connection of four temperature sensitive elements 395 each characterized by a steep negative temperature coefficient and which have, at ambient temperature, a resistance value of approximately five ohms, place twenty ohms of resistance in series with the power line. This amount of resistance is significantly greater than the motor 103 and limits the magnitude of current entering the motor 103 with a corresponding reduction in motor torque and shock being transmitted to the rotor 33.

In the same manner as described for the starting phase, the boost relay 149 is delayed for approximately a half second by the charging time of the capacitor 373 and the fixed resistor 377. Since the series of four resistors 395 require approximately two seconds of heating to significantly decrease in resistance, a considerable series resistance remains at the time the torque boost relay 149 is energized. As in the starting phase, when the torque boost relay 149 is energized, the contact 145 and contact 147 are both transferred to the normally-open position which connects the first capacitor 141 and the second capacitor 143 in parallel with one another which causes a surge in the electrical current, the series of four temperature sensitive elements or resistors 395 heat rapidly dropping substantially in resistive value to approximately only 0.1 ohm each or a combined total resistance of only 0.4 ohm which is negligible compared to the impedience of the motor 103 thereby establishing maximum braking torque. Typically within six seconds after pressing the brake switch 57, the temperature sensitive element 393 will have heated to the switching temperature and the motor 103 and thus the rotor 33 will have accelerated under maximum braking torque but will not yet have reached zero speed. The torque boost relay 387 is then de-energized thereby reconnecting the first capacitor 141 and the second capacitor 143 in series which reduces the braking torque to approximately one quarter of the maximum value which causes the motor 103 and the rotor 33 gently to approach zero speed. As the motor 103 reaches zero speed, the torque which is opposite to the running torque urges the motor 103 to reverse its direction, but, as has been previously explained, the clutch 165 locks and causes the reverse detection arm 160 to rotate barely two degrees thereby actuating the stop switch 176 and interupting the circuit for the relay 179. With the relay 179 is de-energized, power to the motor 103 is turned off since the contactor 397 is de-energized. The de-energizing of the relay 179 also removes power from the voltage divider 381 whereupon the temperature sensitive element 393 immediately beings to cool aided by the cooling fan 65. Cooling of the temperature sensitive elements thermally resets the circuit in preparation for the next cycle.

The cooling fan 65, which draws air from inside the enclosure 25 to the outside, is a vital component in a system such as been previously described, which use timing elements 67 which change resistance with temperature to control the level of electrical current. The operation of the cooling fan 65 is the same whether the centrifuge has been used for a short spin or has been operated for a predetermined time interval.

All the timing elements 67 are physically located so as to be exposed to the maximum flow of the cooling air. This assures that all timing elements 67 which are temperature sensitive will cool rapidly and will thus be reset to permit the next run cycle within ten seconds after completion of a previous braking cycle.

To absolutely assure fast, thermal reset of all timing elements 67, the cooling fan 65 remains on after the relay 179 is de-energized following the braking cycle and with the relay 179 de-energized, the contact 187 and the contact 191 revert to their normally-closed position as set forth in FIGS. 7 and 8. This removes the full-line voltage from the cooling fan 65 through the contact 191 and reconnects the cooling fan 65 to the electrical power supply by means of the contact 187, thus placing the parallel combination of a resistor 403 and a temperature sensitive element 405 in series with the fan. The temperature sensitive element 405 is identical to the temperature sensitive element 375 and the temperature sensitive element 393. With the temperature sensitive element 405 having a resistance of approximately one hundred twenty ohms, which it possesses at ambient temperature and being in parallel with the resistor 403, the voltage across the parallel combination is dropped to reduce the fan speed slightly when the relay 179 is de-energized. The temperature sensitive element 405, however, self-heats to the switching temperature within typically twenty seconds, at which point the resistance suddenly increases by several fold thereby forcing all electrical energy supplied to the fan to flow through the resistor 403 which is typically valued at five hundred ohms. The fan voltage is thus reduced from one hundred fifteen volts to approximately eighty-seven volts and the fan speed is reduced to a point where the fan operating noise level is practically inaudible. The twenty second delay in fan speed reduction promotes faster cooling of the thermal timing elements in preparation for a subsequent run and the continuous low volume air flow after the twenty second delay period cools the motor 103 and also prevents motor residual heat from infiltrating the rotor chamber 31 to cause undesirable heating of the sample tubes 313, assuming that the sample tubes 313 are not immediately removed from the removable tube carrier 309 following operation of the centrifuge.

Should it become necessary to stop the centrifuge in the shortest possible time, whether being operated in a short cycle or for a predetermined time interval, the brake switch 57 is depressed until the motor 103 has reached a complete stop. With the brake switch 57 held down, the relay 154 energizes to initiate the braking cycle and connects a temperature sensitive element 407 in parallel with the temperature sensitive element 393. Since the temperature sensitive element 407 and the temperature sensitive element 393 are identical and as such equally share the current passing through the voltage divider 381 when the brake switch 57 is held down. With only half the normal current flowing in either the temperature sensitive element 407 or the temperature sensitive element 393, the resulting selfheating is not sufficient to raise the temperature of either the temperature sensitive element 393 or the temperature sensitive element 407 to the switching point within the normal time of deceleration and, consequently, the torque boost relay 149 is never de-energized, resulting in the maximum braking effect continuing to the stopping point when the relay 179 is deenergized to remove power from the motor 103. In the event that the thermal overload device in motor 103 should open during operation, holding brake switch 57 depressed cannot, of course, result in normal braking to zero speed and centrifuge will coast to a stop without actuating stop switch 176. If the operator holds switch 57 down for approximately 25 seconds, elements 407 and 393 finally heat to switching temperature and de-energize boost relay 149.

In the event of abnormally high or frequent usage, such as back to back consecutive runs numbering typically more than twenty, the temperature of the motor 103 may rise and operate a thermal cut out within the motor 103. In such a case, the rotor 33 would coast to a stop and not actuate the stop switch 176, leaving the relay 179 energized. Continued depression of the brake switch 57 will, in that case, eventually heat both the temperature sensitive element 393 and the temperature sensitive element 407 to the switching point, thereby de-energizing the torque boost relay 149 and also protect the series/parallel combination of temperature sensitive elements 383 from overheating.

In centrifuges, as well as other apparatus, it is desirable that it accelerate to running speed or decelerate to a stop in a predictable and repeatable time interval. In centrifugation, it is often necessary to repeat the same procedure. Line voltage variations vary the drive motor torque and low-voltage conditions result in longer acceleration and braking periods. A high line voltage condition shortens such intervals. In accordance with this invention, an automatic voltage compensating means exists to make such time periods predictable.

The accelerating torque of an electric motor is proportional to the applied voltage in the region below the saturation point of the motor's magnetic circuit. Inertia is assumed constant, since the load in many cases, and particularily in centrifugation, is identical from run to run. Assuming the line voltage decreases from a nominal 115 VAC to 97 VAC prior to a run, a loss of accelerating torque would normally occur.

In accordance with this invention, a means is provided to compensate for the diminished motor torque. Torque reduction causes a reduced rate of acceleration.

Temperature sensitive element 375, in conjunction with relay 149, produces a timed interval which is also responsive to line voltage changes in a manner which compensates for changes in motor torque output. The instantaneous current is proportional to the instantaneous line voltage. Under low-line voltage conditions, the relay 375 (FIG. 9), remains energized for a longer period and even though the motor accelerating torque is reduced at low voltages, the torque is sustained for a longer period at a reduced line voltage. In this way, the total acceleration period remains nearly constant when the line voltage is reduced.

Should the line voltage increase over the normal level, the motor 103 will accelerate the load at a higher rate. The Temperature Sensitive Element 375 heats to the switching temperature more rapidly and thus the relay 149 deenergizes earlier in the accelerating phase resulting again in a constant total acceleration period.

Compensation is identical in the braking phase.

In the emergency braking mode, the temperature sensitive element 393 does not heat to the switching temperature and relay 149 remains energized maintaining the maximum braking torque as previously explained. In this manner, the compensating mechanism is disabled and the braking period varies by nearly 4 seconds as line voltage is varied ±15%.

In addition to voltage variations, there are temperature variations. This is especially true in centrifugation where procedures may be carried out with the apparatus in a "cold room" and also may be carried out at temperatures as high as 85° F. In order to achieve compensation for temperature changes, temperature sensitive elements 375 and 393 have a characteristic power dissipation rating referred to in terms of power dissipation capability per °C. of temperature change.

Figure 14:
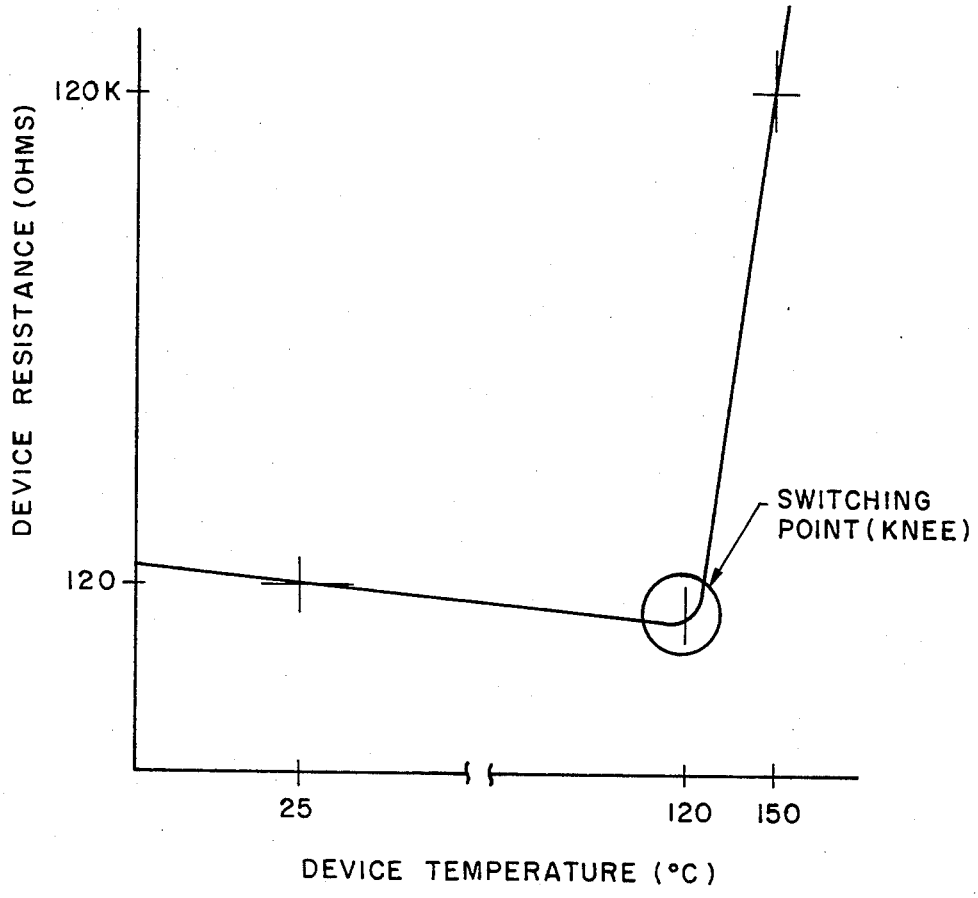
FIG. 14 is a curve showing the resistance to temperature relationship of certain temperature sensitive elements shown in FIGS. 8 and 9.
Figure 15:
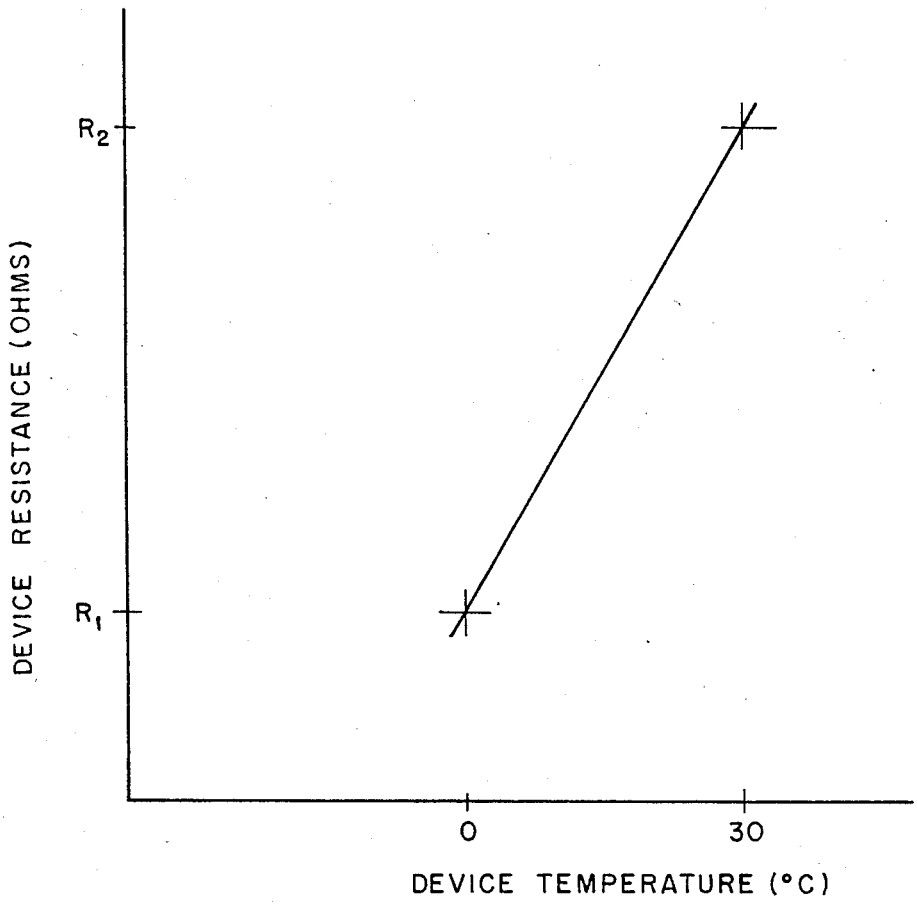
FIG. 15 is a curve showing the resistance to temperature relationship of a series-parallel combination of temperature sensitive elements shown in FIG. 9.

FIG. 14 is a curve describing the resistance to temperature relationship of elements 375, 393 and 407. Assuming a constant initial current in the voltage divider 381, the initial rate of heating in temperature sensitive element 375 and in temperature sensitive element 393 is a constant. The heating time interval will vary with ambient temperature because at low ambient temperature each of the temperature sensitive elements 375, 393 and 407 must undergo a greater change in temperature to reach the temperature at which switching will occur. Conversely at elevated temperatures, each of the temperature sensitive elements 375, 393, 407 is nearer to the temperature at which switching will occur at the start of the heating period and therefore, unless compensated, will reach switching temperature sooner, which will result in a foreshortened boost interval. The consequence would be acceleration and braking intervals which vary as a function of temperature. To achieve temperature compensation, the timing elements 67 which are the Series-Parallel Combination of Temperature Sensitive Elements 383 (FIG. 9) are also temperature sensitive, but as shown in FIG. 16 are not characterized by a sharp knee or switching point but instead have a large positive temperature coefficient of resistance. At lower temperatures the equivalent terminal resistance of the Series-Parallel Combination of Temperature or the temperature sensitive element 393 is reduced so that the initial current is increased in the Series-Parallel Combination of Temperature Elements 383. With increased current, the power dissipation in the Temperature Sensitive Elements 375, 393 increases so that the switching temperature is reached more rapidly. At elevated temperatures, the resistance of the series-parallel combination of Temperature Sensitive Elements increases, reducing the current in either the Temperature Sensitive Element 375 or the temperature sensitive element 393, which increases the time required to reach the switching temperature. A non-temperature dependant resistor 409 is connected in parallel with the series-parallel combination of temperature elements 383 which adjusts the compensating effect. A low value of resistance for resistor 409 reduces the compensating effect, but a high resistance value for the resistor 409 increases the compensation. The value of resistor 409 is set so that acceleration and boost intervals are practically constant with respect to changes in temperature.

A cooling period following each operational cycle of the temperature sensitive elements 375, 393 is necessary so that these temperature sensitive elements 375, 393 are allowed to cool thereby resetting for a successive run. Except for emergency conditions, a minimum off time of typically seven seconds is required to cool and reset the temperature sensitive elements 375, 393 when the run switch 59 is depressed, the relay 149 is immediately energized, which opens contact 389 to the normally open position which interrupts the operation relay 154 for the period the operation relay 154 is energized, typically 7 seconds for a high inertia load such as exists with a centrifuge. During this interval temperature, sensitive element 393 begins to cool from a previous braking interval. Regardless of the setting of timer 61 a braking interval cannot begin until the end of the acceleration period unless an emergency stop is programmed by depressing the brake switch 57. At the end of the acceleration boost interval, relay 154 drops out, returning contacts 389 to the normally-closed position, thus allowing a normal stop to be initiated by either the timer 61, brake switch 57, or access door solenoid lock switch 193. When braking is initiated by any of the three possibilities, relay 154 energizes and holds by means of contact set 411 until the motor 103 is deenergized. During the braking interval, the accelerating mode is inoperative and therefore the temperature sensitive element 375 is able to cool before the next accelerating interval. The sequencing thus described provides the cool-down periods following each duty cycle of temperature sensitive elements 375, 393 respectively.

In the preferred embodiment, the motor and control system disclosed offers performance levels and features not possible with any of the six types of fractional or integral horsepower single phase electric motors of the induction or non-brush type. Also the claimed performance characteristics of the improved art cannot be achieved by the use of any standard single phase electric motor used in connection with the usual alternating current motor controlling devices well known in the art.

Of particular significance is the high value of locked rotor torque per ampere of locked rotor current. This performance factor describes the ability of a particular motor 103 to operate when driving considerable frictional and inertial loads. Obviously, high values of torque to ampere are desirable in order to reduce the starting current to as low a level as possible while maintaining a relatively high starting torque.

While a preferred embodiment has been shown and described, various modifications and substitutions may be made without departing from the spirit and scope of this invention. Accordingly, it is understood that this invention has been described by way of illustration rather than limitation.

I claim:

1. A centrifuge comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm;

a spindle assembly vertically mounted in the baseplate and having a lower end and an upper end, the lower end of the spindle assembly extending through the baseplate;

a rotor including a rotor base with a flat base portion and a cylindrical portion and a rotor cover, said rotor cover being removable from said rotor base, said rotor being mounted on the upper end of said spindle assembly;

a drive pulley mounted on the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley;

a tube carrier removably mounted in the rotor base and including a plurality of tube holders;

an enclosure mounted on the baseplate enclosing the motor assembly and the spindle assembly and the rotor, the enclosure having an access door above the rotor;

a locking mechanism mounted on the enclosure at the access door to prevent opening of the access door during operation of the rotor;

a stop switch located at the upper end of the motor assembly adjacent the reverse detection arm to deactivate the motor when the reverse detection arm strikes the stop switch; and an electrical circuit means including the locking mechanism and the stop switch and further including means to activate the motor with a starting torque, said electrical circuit further including means to reverse the motor torque to a braking torque opposite from the starting torque and to increase substantially the starting and braking torque of the motor.

2. A centrifuge according to claim 1 wherein the motor assembly further includes;

a roller mounting bracket mounted on the motor at the lower end of the motor with a means mounted on the mounting bracket to permit the motor assembly to move in relation to the baseplate;

a tension arm affixed to the roller mounting bracket and pivotably mounted on the baseplate;

a tension spring affixed to the end of the tension arm closest to the point where the tension arm is pivotably mounted on the baseplate and affixed to the baseplate so as to tighten the drive belt, said tension spring being located in a generally horizontal position;

a U-bracket mounted on the upper end of the motor assembly, the stop switch being mounted on the U-bracket;

a pair of hold-down springs extending from the U-bracket to the baseplate, one hold-down spring being substantially vertical and being located adjacent the tension spring and the other holddown spring extending at an incline to the vertical to assist the tension spring in tightening the drive belt.

3. A centrifuge according to claim 1 wherein the spindle assembly further includes:

a spindle housing rigidly secured to the baseplate;

a lower shaft and an upper shaft; and a flexible coupling, the lower shaft and the upper shaft each being connected at one end to the flexible coupling, the lower shaft and the upper shaft and the flexible coupling being rotatable mounted in the spindle housing, the end of the upper shaft remote from the coupling having a tapered end with a cross pin through the upper shaft adjacent the taper.

4. A centrifuge according to claim 1 further including:

an adapter mounted on the upper end of the spindle assembly having a generally cylindrical shape with a female tapered opening and extending into the rotor base.

5. A centrifuge according to claim 1 wherein the rotor cover includes:

a concentrically located grip sleeve which extends upwardly from the rotor cover and having an upper end, the upper end of the grip sleeve being flared;

an outer sleeve threaded into the grip sleeve, said outer sleeve having a ball groove and a counterbore;

an inner sleeve having an upper end and a lower end slidably mounted within the outer sleeve, clearance holes being disposed radially in the inner sleeve near the upper end of the inner sleeve and clearance holes disposed radially in the inner sleeve near the lower end of the inner sleeve;

a push button slidably mounted within the inner sleeve, said push button including a circumferential groove and a magnet being secured within the top of the push button, said circumferential groove in the push button being located above and adjacent the clearance holes in the upper end of the inner sleeve;

an adapter having an opening which engages the upper end of the spindle assembly, and having a circumferential groove, said circumferential groove in the adapter being located adjacent the clearance holes in the lower end of the inner sleeve;

locking balls in the clearance holes in the upper end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby permitting the inner sleeve to release from the adapter and the rotor cover to be released;

a drive pulley mounted on the lower shaft of the motor assembly and a driven pulley mounted on the lower end of the groove, said circumferential groove in the adapter being located adjacent the clearance holes in the lower end of the inner sleeve;

locking balls fitted within the clearance holes at the upper end and at the lower end of the inner sleeve, the locking balls in the clearance holes at the lower end of the inner sleeve extending into the circumferential groove of the adapter holding the inner sleeve to the adapter, the locking balls in the clearance holes at the upper end of the inner sleeve extending into the ball groove in the outer sleeve until the push button is depressed causing the locking balls in the clearance holes in the upper end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby premitting the inner sleeve to release from the adapter and the rotor cover to be released.

6. A centrifuge according to claim 1 wherein the rotor cover includes:

a concentrically located grip sleeve which extends upwardly from the top of the rotor cover, with an upper end, the upper end of the grip sleeve being flared;

an outer sleeve threaded into the grip sleeve, said outer sleeve having a ball groove and a counterbore;

an inner sleeve having an upper end and a lower end slidably mounted within the outer sleeve, clearance holes being disposed radially in the inner sleeve near the upper end of the inner sleeve and clearance holes disposed radially in the inner sleeve near the lower end of the inner sleeve;

a push button slidably mounted within the inner sleeve, said push button including a circumferential groove and a magnet being secured within the top of the push button said circumferential groove in the push button being located above and adjacent the clearance holes in the upper end of the inner sleeve, said push button further having a concentric opening extending through it;

an adapter having an opening which engages the upper end of the spindle assembly and having a circumferential groove, said circumferential groove in the adapter being located adjacent the clearance holes in the lower end of the inner sleeve, the adapter further having a concentric opening extending through the adapter and aligned with the concentric opening in the push button, said spindle assembly having a bolt threaded in it, said bolt extending through the adapter;

locking balls fitted within the clearance holes at the upper end and at the lower end of the inner sleeve, the locking balls in the clearance holes at the lower end of the inner sleeve extending into the circumferential groove of the adapter holding the inner sleeve to the adapter, the locking balls in the clearance holes at the upper end of the inner sleeve extending into the ball groove in the outer sleeve until the push button is depressed causing the locking balls in the clearance holes in the upper end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby permitting the inner sleeve to release from the adapter and the rotor cover to be released.

7. A centrifuge according to claim 1, further including:

a cooling fan mounted in the enclosure and connected to electrical circuit means, the electrical circuit means including a temperature sensitive element to reduce the speed of the cooling fan after the motor has stopped.

8. A centrifuge according to claim 1 further including a belt switch mounted in the baseplate adjacent to the motor assembly, said belt switch being connected to the electrical circuit means to deenergize the motor when activated.

9. A centrifuge according to claim 1 wherein:

the motor assembly includes a tension arm located between the baseplate and the motor, the tension arm being rigidly secured to the motor and being pivotably mounted in the baseplate; and further including:

a spring means connected to the motor assembly to hold the motor assembly against the baseplate and to rotate the motor assembly away from the spindle assembly, said motor assembly being retained from rotating away from the spindle assembly by the drive belt.

10. A centrifuge according to claim 1 wherein:

the motor assembly includes a tension arm located between the baseplate and the motor, the tension arm being rigidly secured to the motor and being pivotably mounted in the baseplate; and further including a spring means connected to the motor assembly to hold the motor assembly against the baseplate and to rotate the motor assembly away from the spindle assembly, said motor assembly being prevented from rotating by the drive belt; and a belt switch mounted on the baseplate adjacent to the motor assembly and adapted to be activated by the motor assembly when the drive belt breaks, said belt switch being connected to the electrical circuit means to deenergize the motor when activated.

11. A centrifuge according to claim 1 further including:

a magnet located in the rotor cover; and a rotor sensor switch mounted on the access door above the rotor and included within the electrical circuit means, said rotor sensor switch being normally open and being closed by close proximity to the magnet when the rotor cover is properly affixed to the rotor base.

12. A centrifuge according to claim 1 wherein the electrical circuit means further includes:

a main power switch;

a brake switch;

a run switch;

a timer;

an interval timer control switch, the main power switch, the brake switch, the run switch and the timer all being located in the enclosure;

means coextensive with the means to increase the starting torque and braking torque including a pair of capacitors;

means including switching means to connect the pair of capacitors in parallel to obtain maximum torque from the motor and in series to obtain reduced torque from the motor;

means including a single capacitor and a fixed resistor connected in series to delay the actuation of the switching means to connect the capacitors in parallel both when the torque of the motor is in the starting torque and when the torque of the motor is the reverse torque;

means including a first temperature sensitive element to actuate the switching means to reconnect the pair of capacitors in series when the torque of the motor is the starting torque;

means including a second temperature sensitive element to actuate the switching means to reconnect the pair of capacitors in series when the torque of the motor is the reverse torque; and a unidirectional clutch mounted in the reverse detection arm, the upper shaft of the motor being mounted in the unidirectional clutch, said unidirectional clutch being adapted to rotate with the upper shaft only in the direction of rotation of the starting torque causing the reverse detection arm to strike the stop switch when the reverse direction of rotation begins, the stop switch being adapted to stop the operation of the motor.

13. A centrifuge according to claim 1, wherein the electrical circuit means further includes:

a main power switch;

a brake switch;

a run switch;

a timer;

an interval timer control switch, the main power switch, the brake switch, the run switch and the timer all being located in the enclosure;

means coextensive with the means to increase the starting torque and braking torque including a pair of capacitors;

means including switching means to connect the pair of capacitors in parallel to obtain maximum torque from the motor and in series to obtain reduced torque from the motor;

means including a single capacitor and a fixed resistor connected in series to delay the activation of the switching means to connect the capacitors in parallel both when the torque of the motor is the starting torque and when the torque of the motor is the reverse torque;

means including a first temperature sensitive element to reconnect the pair of capacitors in series when the torque of the motor ia the starting torque;

means including a second temperature sensitive element to actuate the switching means to reconnect the pair of capacitors in series when the torque of the motor is the reverse torque;

a unidirectional clutch mounted in the reverse detection arm, the upper shaft of the motor being mounted in the unidirectional clutch, said unidirectional clutch being adapted to rotate with the upper shaft only in the direction of rotation of the starting torque causing the reverse detection arm to strike the stop switch when the reverse direction of rotation begins, the stop switch being adapted to stop the operation of the motor;

a cooling fan mounted in the enclosure, the first temperature sensitive element and the second temperature element being located in the close proximity to the cooling fan; and means including a resistor and a third temperature sensitive element in parallel with one another and in series with the cooling fan to reduce the voltage, and further including means to connect the resistor and third temperature sensitive element in series with the cooling fan when the motor is deactivated by the stop switch.

14. A centrifuge according to claim 1 wherein the tube carrier removably mounted in the rotor base includes two rows of concentric tube holders, each row mounted at the maximum spin radius of that row.

15. A centrifuge comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm mounted on the upper end, a unidirectional clutch being mounted in the reverse detection arm;

a spindle assembly vertically mounted in the baseplate end having a lower end and an upper end, the lower end of the spindle assembly extending through the baseplate, said spindle assembly including a spindle housing, a lower shaft, an upper shaft and a flexible coupling, the lower shaft and the upper shaft each being connected at one end to the flexible coupling and the lower shaft and the upper shaft and the flexible coupling being rotatable mounted in the spindle housing, the spindle housing being rigidly secured to the baseplate;

a rotor including a rotor base with a flat base portion and a cylindrical portion and a rotor cover, said rotor cover being removable from said rotor base, said rotor being mounted on the upper end of said spindle assembly, the rotor cover including a concentrically located grip sleeve extending upwardly from the rotor cover and having an upper end, the upper end of the grip sleeve being flared, an outer sleeve threaded into the grip sleeve, an inner sleeve slidably mounted within the outer sleeve, a push button slidably mounted within the inner sleeve, a magnet mounted in the push button, an adapter having an opening which engages the upper end of the spindle assembly and fits within the inner sleeve;

a drive pulley mounted on the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley;

an enclosure mounted on the baseplate enclosing the motor assembly and the spindle assembly and the rotor, the enclosure having an access door above the rotor;

a stop switch located adjacent the reverse detection arm to deactivate the motor when the reverse detection arm strikes the stop switch; and an electrical circuit means including means to activate the motor and the locking mechanism and the stop switch, said electrical circuit further including a pair of capacitors to increase the starting and braking torque of the motor to a level substantially in excess of the operating torque of the motor.

16. A centrifuge according to claim 15 wherein the motor assembly further includes;

a mounting bracket mounted on the motor at the lower end with a means mounted on the mounting bracket to permit the motor assembly to move in relation to the baseplate;

a tension arm affixed to the roller mounting bracket and pivotably mounted on the baseplate;

a tension spring affixed to the end of the tension arm closest to the point where the tension arm is pivotably mounted on the baseplate and affixed to the baseplate so as to tighten the drive belt, said tension spring being located in a generally horizontal position;

a U-bracket mounted on the upper end of the motor assembly, the stop switch being mounted on the U-bracket; and a pair of hold-down springs extending from the U-bracket to the baseplate, one hold-down spring being substantially vertical and being located adjacent the tension spring and the other holddown spring extending at an incline to the vertical to assist the tension spring in tightening the pulley.

17. A centrifuge according to claim 15 wherein:

the outer sleeve has a ball groove and a counterbore;

the inner sleeve has an upper end and a lower end with clearance holes disposed radially in the inner sleeve near the upper end of the inner sleeve and clearance holes disposed radially in the inner sleeve near the lower end of the inner sleeve;

the adapter having a circumferential groove located adjacent the clearance holes in the lower end of the inner sleeve;

said centrifuge further including:

locking balls fitted within the clearance holes at the upper end and at the lower end of the inner sleeve, the locking balls in the clearance holes at the lower end of the inner sleeve extending into the circumferential groove of the adapter holding the inner sleeve to the adapter, the locking balls in the clearance holes at the upper end of the inner sleeve extending into the ball groove in the outer sleeve until the push button is depressed causing the locking balls in the clearance holes in the upper end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby permitting the inner sleeve to release from the adapter and the rotor cover to be released.

18. A centrifuge according to claim 15 wherein the electrical circuit means further includes:

a main power switch;

a brake switch;

a run switch;

a timer;

an interval timer control switch, the main power switch, the brake switch and the timer all being located on the enclosure;

means including switching means to connect the pair of capacitors in parallel to obtain maximum torque from the motor and in series to obtain reduced torque from the motor;

means including a single capacitor and a fixed resistor connected in series to delay the actuation of the switching means to connect the capacitors in parallel both when the torque of the motor is the starting torque and when the torque of the motor is the reverse torque;

means including a first temperature sensitive element to reconnect the pair of capacitors in series when the torque of the motor is the starting torque;

means including a second temperature sensitive element to reconnect the pair of capacitors in series when the torque of the motor is the reverse torque;

a cooling fan mounted in the enclosure, the first temperature sensitive element and the second temperature element being located in close proximity to the cooling fan;

means including a resistor and a third temperature sensitive element in parallel with on another and further including means to connect the resistor and third temperature sensitive element in series with the cooling fan when the motor is deactivated by the stop switch, the unidirectional clutch being adapted to rotate with the upper shaft only in the direction of rotation of the starting torque causing the reverse detection arm to strike the stop switch.

19. A centrifuge comprising:

a baseplate;

a motor assembly with an upper end and a lower end pivotably mounted in vertical position on the baseplate and including a motor having an upper shaft at the upper end and a lower shaft at the lower end, the lower shaft extending through the baseplate, said motor being a brushless, induction motor, said motor assembly further including a reverse detection arm mounted on the upper end, a unidirectional clutch being mounted on the reverse detection arm, said motor assembly further including a roller mounting bracket mounted on the motor at the lower end with a pair of rollers in contact with the baseplate mounted on the roller mounting bracket, a tension arm affixed to the roller mounting bracket and pivotably mounted on the baseplate, a tension spring affixed at one end to the end of the tension arm closest to the point where the tension arm is pivotably mounted on the baseplate and is affixed to the other end of the baseplate, said tension spring being located in a generally horizontal position, a U-bracket mounted on the upper end of the motor assembly, the stop switch being mounted on the bracket, and a pair of hold-down springs extending from the U-bracket to the baseplate, one hold-down spring being substantially vertical and being located adjacent the tension spring and the other hold-down spring extending at an incline to the vertical to assist the tension spring in tightening the drive belt;

a spindle assembly vertically mounted on the baseplate and having a lower end and a upper end, the lower end of the spindle assembly extending through the baseplate, said spindle assembly including a spindle housing rigidly secured to the baseplate and a lower shaft and an upper shaft and a flexible coupling, the lower shaft and the upper shaft being connected at one end to the flexible coupling, the lower shaft and the upper shaft and the flexible coupling being rotatably mounted in the spindle housing, the end of the upper shaft remote from the coupling having a tapered end with a cross pin through the upper shaft adjacent the taper;

a rotor including a rotor base with a flat portion and a cylindrical portion and a rotor cover, said rotor cover being removable from said rotor base, said rotor being mounted in the upper end of said spindle assembly, said rotor cover including a concentrically located grip sleeve which extends upwardly from the rotor cover and having an upper end, the upper end of the grip sleeve being flared, an outer sleeve threaded into the grip sleeve, said outer sleeve having a ball groove and a counterbore; an inner sleeve having an upper and a lower end slidably mounted within the outer sleeve, clearance holes disposed radially in the inner sleeve near the upper end of the inner sleeve and clearance holes disposed radially in the inner sleeve near the lower end of the inner sleeve, a push button slidably mounted within the inner sleeve, said push button including a circumferential groove and a magnet being secured within the top of the push button, said circumferential groove in the push button being located above and adjacent the clearance holes in the upper end of the inner sleeve; an adapter having an opening adapted to engage the upper end of the spindle assembly, the adapter having a circumferential groove, said circumferential groove on the adapter located adjacent the clearance holes in the lower end of the inner sleeve, locking balls filled within the clearance holes at the upper end and at the lower end of the inner sleeve, the locking balls an the clearance holes at the lower end of the inner sleeve extending into the circumferential groove of the adapter holding the inner sleeve to the adapter, the locking balls in the clearance holes at the upper end of the inner sleeve extending into the ball groove in the outer sleeve until the push button is depressed causing the locking balls in the upper clearance holes in the end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby permitting the inner sleeve to release from the adapter and the rotor cover to be released;

a drive pulley mounted on the lower shaft of the motor assembly and a driven pulley mounted on the lower end of the spindle assembly, the pulley having a diameter substantially larger than the diameter of the driven pulley;

a drive belt mounted on and connecting the drive pulley and the driven pulley;

a tube carrier removably mounted in the rotor base and including a plurality of tube holders, each row mounted at the maximum open radius of that row;

a locking mechanism mounted on the enclosure at the access door to prevent operation of the motor assembly when the access door is open;

an electrical circuit means including a stop switch located at the upper end of the motor assembly adjacent to the reverse detection arm to deactivate the motor when the reverse detection arm strikes the stop switch, and further including means to activate the motor and the locking mechanism, said electrical circuit further including a main power switch, a brake switch, a run switch, a timer , an interval timer control switch, the main power switch, the brake switch, the run switch and the timer all being located in the enclosure, means including switching means to connect the pair of capacitors in parallel to obtain maximum torque from the motor and in series to obtain reduced torque from the motor, means including a single capacitor and a fixed resistor connected in series to delay the actuation of the switching means to connect the capacitors in parallel both when the torque of the motor is the starting torque and when the torque of the motor is the reverse torque, means including a first temperature sensitive element to actuate the switching means to reconnect the pair of capacitors in series when the torque of the motor is the starting torque, and means including a second temperature sensitive element to actuate the switching means to reconnect the pair of capacitors in series when the torque of the motor is the reverse torque.

20. A mechanism for use in a rotating apparatus such as a centrifuge, said mechanism comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, the motor assembly including a reverse detection arm mounted on the upper end and a unidirectional clutch being mounted in the reverse detection arm, said motor assembly further including a roller mounting bracket on the motor at the lower end with a pair of rollers mounted on the roller mounting bracket, said rollers being in contact with the baseplate, a tension arm affixed to the roller mounting bracket and pivotably mounted on the baseplate, a tension spring affixed to the end of the tension arm closest to the point where the tension arm is pivotably mounted on the baseplate and affixed to the baseplate, said tension spring being located in a generally horizontal position, a U-bracket mounted on the upper end of the motor assembly, a stop switch being mounted on the bracket, and a pair of hold-down springs extending from the U-bracket to the baseplate, one hold-down spring being substantially vertical and being located adjacent the tension spring and the other hold-down spring extending at an incline to the vertical to assist the tension spring in tightening the drive pulley;

a spindle assembly vertically mounted on the baseplate and having a lower end and an upper end, the lower end of the spindle assembly extending through the baseplate, said spindle assembly including a spindle housing rigidly secured to the baseplate and a lower shaft, an upper shaft and a flexible coupling, the lower shaft and the upper shaft being connected at one end to the flexible coupling being rotatably mounted in the spindle housing;

a drive pulley mounted in the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley, the drive belt being tightened by the tension spring; and an electrical circuit means including means to activate the motor with a starting torque, said electrical circuit further including means to reverse the motor torque in a direction opposite from the starting torque and to increase substantially the starting torque and the braking torque of the motor, the means to increase substantially the starting torque and the braking torque including switching means to connect the pair of capacitors in parallel to obtain maximum torque from the motor and in series to obtain reduced torque from the motor, means including a single capacitor and a fixed resistor connected in series to delay the actuation of the switching means to connect the capacitors in parallel both when the torque of the motor is the starting torque and when the torque of the motor is the reverse torque, said switching means including a first temperature sensitive element to reconnect the pair of capacitors in series when the torque of the motor is the starting torque and a second temperature sensitive element to reconnect the pair of capacitors in series when the torque of the motor is the reverse torque.

21. A mechanism for use in a rotating apparatus such as a centrifuge, said mechanism comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm;

a spindle assembly vertically mounted in the baseplate and having a lower end and an upper end, the lower end of the spindle assembly extending through the baseplate;

means for connecting the motor assembly to the spindle assembly to cause the spindle assembly to rotate;

a stop switch located at the upper end of the motor assembly adjacent the reverse detection arm to deactivate the motor when the reverse detection arm strikes the stop switch; and an electrical circuit means including means to activate the motor with a starting torque, said electrical circuit further including means to reverse the motor torque in a direction opposite from the starting torque and means including pair of capacitors to increase the starting and braking torque of the motor to a level substantially in excess of the operating torque of the motor, means including switching means to connect the pair of capacitors in parallel to obtain maximum torque from the motor and in series to obtain reduced torque from the motor, means including a single capacitor and a fixed resistor connected in series to delay the actuation of the switching means to connect the capacitors in parallel when the torque of the motor is the starting torque and when the torque of the motor is the reverse torque, means including a first temperature sensitive element to actuate the switching means to reconnect the pair of capacitors in series when the torque of the motor is the starting torque; means including a second temperature sensitive element to actuate the switching means to reconnect the pair of capacitors in series when the torque of the motor is the reverse torque.

22. A centrifuge comprising:

a motor assembly;

a spindle assembly;

a rotor including a rotor base and a rotor cover, said rotor cover being removable from said rotor base, said rotor being mounted on said spindle assembly, said rotor cover including a concentrically located grip sleeve which extends upwardly from the top of the rotor cover, and having an upper end, the upper end of the grip sleeve being flared;

an outer sleeve threaded into the grip sleeve, said outer sleeve having a ball groove and a counterbore;

an inner sleeve having an upper end and a lower end slidably mounted within the outer sleeve, clearance holes being disposed radially in the inner sleeve near the upper end of the inner sleeve and clearance holes disposed radially in the inner sleeve near the lower end of the inner sleeve;

a push button slidably mounted within the inner sleeve, said push button including a circumferential groove said circumferential groove in the push button being located above and adjacent the clearance holes in the upper end of the inner sleeve, said push button further having a concentric opening extending through it;

an adapter having an opening which engages the upper end of the spindle assembly and having a circumferential groove, said circumferential groove in the adapter being located adjacent the clearance holes in the lower end of the inner sleeve, the adapter further having a concentric opening extending through the adapter and aligned with the concentric opening in the push button, said spindle assembly having a bolt threaded in it, said bolt extending through the adapter;

locking balls fitted within the clearance holes at the upper end at the lower end of the inner sleeve, the locking balls in the clearance holes at the lower end of the inner sleeve extending into the circumferential groove of the adapter holding the inner sleeve to the adapter, the locking balls in the clearance holes at the upper end of the inner sleeve extending into the ball groove in the outer sleeve until the push button is depressed causing the locking balls in the clearance holes in the upper end of the inner sleeve to enter the circumferential groove in the push button thereby permitting the outer sleeve to move upwardly in relation to the inner sleeve permitting the locking balls in the clearance holes at the lower end of the inner sleeve to enter the counterbore of the outer sleeve thereby permitting the inner sleeve to release from the adapter and the rotor cover to be released; and drive means for connecting the motor assembly to the spindle assembly to rotate the spindle assembly.

23. A centrifuge according to claim 22 having a magnet secured within the top of the push button.

24. A centrifuge comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm;

a spindle assembly vertically mounted in the baseplate and having a lower end and an upper end of the spindle assembly extending through the baseplate;

a rotor including a rotor base and a rotor cover, said rotor cover being removable from said rotor base, said rotor being mounted on the upper end of said spindle assembly, a seal being located between the rotor cover and the rotor base, the rotor base including a lip which extends vertically above the seal and inwardly toward the rotor cover to form an enclosure outside and around the seal;

a rotor including a rotor base with a flat base portion and a cylindrical portion and a rotor cover, said rotor cover being removable from said rotor base, said rotor being mounted on the upper end of said spindle assembly;

a drive pulley mounted on the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley;

a tube carrier mounted on the rotor base and including a plurality of tube holders;

an enclosure mounted on the baseplate enclosing the motor assembly and the spindle assembly and the rotor, the enclosure having an access door above the rotor; and a stop switch located at the upper end of the motor assembly adjacent the reverse detection arm to deactivate the motor when the reverse detection arm strikes the stop switch.

25. A centrifuge comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm;

a spindle assembly vertically mounted in the baseplate and having a lower end and an upper end, the lower end of the spindle assembly extending through the baseplate;

a rotor including a rotor base and a rotor cover, said rotor cover being removable from said rotor base, said rotor being mounted on the upper end of said spindle assembly, a seal being located between the rotor cover and the rotor base, the rotor base including a lip which extends vertically above the seal and inwardly toward the rotor cover to form an enclosure outside and around the seal;

a drive pulley mounted on the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley;

a tube carrier removably mounted in the rotor base and including a plurality of tube holders;

an enclosure mounted on the baseplate enclosing the motor assembly and the spindle assembly and the rotor, the enclosure having an access door above the rotor;

a locking mechanism mounted on the enclosure at the access door to prevent opening of the access door during operation of the rotor;

a stop switch located at the upper end of the motor assembly adjacent the reverse detection arm to deactivate the motor when the reverse detection arm strikes the stop switch; and an electrical circuit means including the locking mechanism and the stop switch and further including means to activate the motor with a starting torque, said electrical circuit further including means to reverse the motor torque to a braking torque opposite from the starting torque and to increase substantially the starting and braking torque of the motor.

26. A centrifuge according to claim 24 wherein the rotor base provides radial support for the tube carrier.

27. A centrifuge comprising:

a baseplate;

a motor assembly with an upper end and a lower end pivotably mounted in a vertical position on the baseplate and including a motor having an upper shaft at the upper end and a lower shaft at the lower end, the lower shaft extending through the baseplate, said motor assembly further including a reverse detection arm;

a spindle assembly vertically mounted in the baseplate and having a lower end and an upper end, the lower end of the spindle assembly extending through the baseplate;

a rotor including a rotor base with a flat base portion and a cylindrical portion and a rotor cover, said rotor cover being removable from said rotor base, said rotor being mounted on the upper end of said spindle assembly;

a drive pulley mounted on the lower shaft of the motor assembly and a driven pulley mounted on the lower end of the spindle assembly, the drive pulley having a diameter substantially larger than the diameter of the driven pulley;

a drive belt mounted on and connecting the drive pulley and the driven pulley;

a tube carrier removably mounted in the rotor base and including a plurality of tube holders;

an enclosure mounted on the baseplate enclosing the motor assembly and the spindle assembly and the rotor, the enclosure having an access door above the rotor;

a stop switch located at the upper end of the motor assembly adjacent the reverse detection arm to deactivate the motor when the reverse detection arm strikes the stop switch; and an electrical circuit means including means to actuate the motor with a starting torque and to reverse the motor to a braking torque opposite from the starting torque and to increase substantially the starting and braking torque of the motor, said electrical circuit further including means to maintain constant the interval of increased starting and braking torque of the motor regardless of ambient temperature changes.

* * * * *